US012791033B2

(12) United States Patent
Tang et al.

(10) Patent No.: US 12,791,033 B2
(45) Date of Patent: Nov. 10, 2026

(54) AXIAL FLOW BLOWER

(71) Applicant: Greenworks (Jiangsu) Co., Ltd, Changzhou (CN)

(72) Inventors: Yabin Tang, Changzhou (CN); Yunjie Shangguan, Changzhou (CN)

(73) Assignee: Greenworks (Jiangsu) Co., Ltd, Changzhou (CN)

( * ) Notice: Subject to any disclaimer, the term of this patent is extended or adjusted under 35 U.S.C. 154(b) by 0 days.

(21) Appl. No.: 19/014,278

(22) Filed: Jan. 9, 2025

(65) Prior Publication Data

US 2025/0146494 A1 May 8, 2025

Related U.S. Application Data

(63) Continuation of application No. PCT/CN2023/107667, filed on Jul. 17, 2023.

(30) Foreign Application Priority Data

Jul. 18, 2022 (CN) ..... 202210840166.9
Oct. 9, 2022 (CN) ..... 202211224885.4
(Continued)

(51) Int. Cl.
*F04D 19/00* (2006.01)
*F04D 25/06* (2006.01)
(Continued)

(52) U.S. Cl.
CPC ..... *F04D 19/002* (2013.01); *F04D 25/0673* (2013.01); *F04D 25/082* (2013.01);
(Continued)

(58) Field of Classification Search
CPC .... F04D 29/667; F04D 19/002; F04D 29/384; F05D 2240/307
See application file for complete search history.

(56) References Cited

U.S. PATENT DOCUMENTS 2,592,471 A * 4/1952 Sawyer ..... F04D 29/384 415/220
4,981,414 A * 1/1991 Sheets ..... F04D 29/68 415/149.1
(Continued)

FOREIGN PATENT DOCUMENTS

CN 112900334 A * 3/2009 ..... E01H 29/388
CN 105370592 A 3/2016
(Continued)

OTHER PUBLICATIONS

Yang et al (CN 112343847) machine translation (Year: 2021).*
(Continued)

*Primary Examiner* — Brian Christopher Delrue

(57) ABSTRACT

An axial flow blower includes a housing assembly, an air inlet assembly assembled with the housing assembly, an air outlet assembly and a motor duct assembly connected between the air inlet assembly and the air outlet assembly. The motor duct assembly includes a duct body, a motor fixed inside the duct body, a guiding cone mounted and matched with a first end of the duct body, and a fan blade mounted and matched with a second end of the duct body. The fan blade is fixed on a motor shaft of the motor, and a diameter of the fan blade is from 64 mm to 100 mm, and a diameter of the motor is from 30 mm to 50 mm, so that a power of the axial flow blower is greater than or equal to 2000 W and a blowing force is greater than or equal to 2500 g.

19 Claims, 24 Drawing Sheets

(30) Foreign Application Priority Data

Oct. 9, 2022 (CN) ..... 202222637805.X
Oct. 9, 2022 (CN) ..... 202222637923.0

(51) Int. Cl.
*F04D 25/08* (2006.01)
*F04D 29/38* (2006.01)
*F04D 29/52* (2006.01)
*F04D 29/58* (2006.01)
*F04D 29/66* (2006.01)

(52) U.S. Cl.
CPC ..... *F04D 29/388* (2013.01); *F04D 29/522* (2013.01); *F04D 29/5813* (2013.01); *F04D 29/663* (2013.01)

(56) References Cited

U.S. PATENT DOCUMENTS 5,152,661 A * 10/1992 Sheets ..... F04D 29/544 415/208.4
5,437,539 A * 8/1995 Gysling ..... F04D 15/0055 415/68
5,839,205 A * 11/1998 Hung ..... F04D 17/165 417/423.5
5,894,630 A * 4/1999 Bitner ..... A47L 5/14 15/330
6,004,093 A * 12/1999 Ishikawa ..... F04D 29/083 415/57.2
6,460,272 B2 * 10/2002 Cheng ..... F26B 21/001 34/96
7,739,773 B2 * 6/2010 Schliemann ..... F04D 19/007 15/344
7,942,627 B2 * 5/2011 Jin ..... F04D 29/542 415/209.1
8,197,198 B2 * 6/2012 Miyabara ..... F04D 19/007 415/209.1
8,936,434 B2 * 1/2015 Peterson ..... F04D 25/084 415/218.1
10,375,901 B2 * 8/2019 Bermudez ..... A01G 20/47
10,947,983 B2 * 3/2021 Hoffman ..... A01G 20/47
11,067,087 B2 * 7/2021 Tirone ..... F04D 25/084
12,215,716 B2 * 2/2025 Czerwonka ..... F04D 29/667
12,338,933 B1 * 6/2025 Gerwitz ..... A01G 20/47
12,385,494 B2 * 8/2025 Herrera ..... F04D 29/388
2004/0060274 A1 * 4/2004 Thomas ..... B25F 3/00 56/12.7
2006/0034688 A1 * 2/2006 Kupferberg ..... F04D 29/164 415/211.2
2008/0089785 A1 * 4/2008 Schliemann ..... E01H 1/0809 415/208.1
2008/0189904 A1 * 8/2008 Schliemann ..... F04D 19/007 417/234
2013/0247327 A1 * 9/2013 Domingo ..... A01G 20/47 15/324
2014/0140861 A1 5/2014 Pellenc
2015/0143657 A1 5/2015 Gindele et al.
2016/0195097 A1 * 7/2016 Patrick ..... F04D 29/5806 415/124.2
2017/0122327 A1 * 5/2017 Maier ..... F04D 25/0613
2018/0087513 A1 * 3/2018 Hoffman ..... F04D 29/542
2019/0045725 A1 * 2/2019 Shangguan ..... A01G 20/40
2022/0061235 A1 * 3/2022 Dettling ..... E01H 1/0809
2022/0183241 A1 * 6/2022 Liu ..... H02K 5/207

FOREIGN PATENT DOCUMENTS

CN 105986554 A 10/2016
CN 107956721 A * 4/2018 ..... F04D 25/08
CN 110685962 A * 1/2020 ..... F04D 25/0606
CN 111608935 A * 9/2020 ..... F04D 27/001
CN 111749912 A 10/2020
CN 112343847 A * 2/2021 ..... E01H 1/0809
CN 213808160 U 7/2021
CN 215052532 U 12/2021
CN 114673671 A * 6/2022 ..... F04D 19/007
CN 114776614 A * 7/2022 ..... F04D 29/663
CN 218581841 U * 3/2023
EP 2031208 A2 * 3/2009 ..... F04D 29/388
EP 4286590 A1 12/2023
EP 4306807 A1 1/2024
WO 2022028384 A1 2/2022

OTHER PUBLICATIONS

Partial Supplementary European Search Report of Counterpart European Patent Application No. 23842243.0 issued on Sep. 22, 2025.
International Search Report of PCT Patent Application No. PCT/CN2023/107667 issued on Nov. 1, 2023.

* cited by examiner

AXIAL FLOW BLOWER

CROSS REFERENCE TO RELATED APPLICATION

The present application is a continuation Application of PCT application No. PCT/CN2023/107667 filed on Jul. 17, 2023, which claims the benefit of CN202210840166.9 filed on Jul. 18, 2022, CN202211224885.4 filed on Oct. 9, 2022, CN202222637923.0 filed on Oct. 9, 2022, and CN202222637805.X filed on Oct. 9, 2022. All the above are hereby incorporated by reference for all purposes.

TECHNICAL FIELD

The disclosure relates to an axial flow blower, and belongs to a technical field of blowers.

BACKGROUND

Conventional blowers include gasoline blowers and lithium-electric blowers. For gasoline blowers, the diameter of the fan blades is usually more than 250 mm, the blowing force is more than 3000 g, and the power is about 4 KW. While for lithium-electric blowers, the diameter of the fan blades is usually from 80 mm to 90 mm, the power is from 1500 W to 2000 W, and the blowing force is generally less than 2000 g, which cannot compete with gasoline blowers.

In view of this, it is necessary to improve the conventional lithium-electric blowers to solve the problems mentioned above.

SUMMARY

The disclosure provides an axial flow blower. The axial flow blower can increase power and blowing force, so that an overall performance of the axial flow hair blower is improved, thereby being able to compete with gasoline blowers and improving market advantages.

One of more embodiments of the disclosure provide the axial flow blower. The axial flow blower includes a housing assembly, an air inlet assembly assembled with the housing assembly, an air outlet assembly and a motor duct assembly connected between the air inlet assembly and the air outlet assembly. The motor duct assembly includes a duct body, a motor fixed inside the duct body, a guiding cone mounted and matched with a first end of the duct body, and a fan blade mounted and matched with a second end of the duct body. The fan blade is fixed on a motor shaft of the motor, and a diameter of the fan blade is from 64 mm to 100 mm, and a diameter of the motor is from 30 mm to 50 mm, so that a power of the axial flow blower is greater than or equal to 2000 W and a blowing force is greater than or equal to 2500 g.

Further, the fan blade is a metal fan blade, and a density of the metal fan blade is less than or equal to 6.8 g/cm$^3$, so as to enable a dynamic balance value of the fan blade is from 2 mg to 20 mg.

Further, a power P of the motor is greater than or equal to 1500 W, a maximum rotating speed n is greater than or equal to 30000 RPM, the diameter d of the fan blade is greater than or equal to 84 mm, and the fan blade is made of a metal material with a density p less than or equal to 2.8 g/cm$^3$.

Further, the power P of the motor is 1500 W or 2000 W, when the power P of the motor is 1500 W, the diameter d of the fan blade is 84 mm, and when the power P of the motor is 2000 W, the diameter d of the fan blade is 96 mm.

Further, the fan blade is accommodated in the duct body, and a gap is left between a tail end of the fan blade and an inner wall surface of the duct body in a radial direction of the fan blade.

Further, the gap is less than or equal to 1.2 mm.

Further, a second air inlet is arranged on a side of the duct body close to the fan blade, a first air outlet is arranged on a side of the guiding cone away from the fan blade, and the second air inlet is communicated with the first air outlet to form an air flow passage in the duct body.

Further, the duct body is provided with an accommodating part to accommodate the motor, an accommodating cavity is formed in the accommodating part, the motor is accommodated in the accommodating cavity, the second air inlet is arranged on a side of the accommodating part close to the fan blade, and the air flow passage passes through the motor and the accommodating cavity from the second air inlet to reach the first air outlet.

One or more embodiments of the disclosure provide the axial flow blower. The axial flow blower includes the housing assembly, the air inlet assembly, the air outlet assembly, and the motor duct assembly. The air inlet assembly is assembled with the housing assembly, and the motor duct assembly is connected between the air inlet assembly and the air outlet assembly. The motor duct assembly includes the duct body, the motor fixed inside the duct body, and the guiding cone mounted and matched with an end of the duct body. The air inlet assembly includes a first air inlet and a first air inlet tube connected with the first air inlet. The first air inlet tube is connected with the duct body, the air outlet assembly includes a bent tube, a bellow tube fixedly connected with the bent tube, and an air outlet tube fixedly connected with the bellow tube, the guiding cone extends into the bent tube, and a distance between a tail end port of the guiding cone and a central axis of a second air outlet of the bent tube is greater than or equal to 75 mm.

Further, the distance between the tail end port of the guiding cone and the central axis of the second air outlet of the bent tube is greater than or equal to 80 mm.

Further, the central axis of the second air outlet of the bent tube is a same axis as a central axis of the bellow tube, one end of a third air inlet of the bent tube extends into the duct body and is rotatably connected with the duct body, and a central axis of the third air inlet of the bent tube is a same axis as a central axis of the duct body.

Further, a housing part is arranged at one end of the duct body close to the bent tube, an inner diameter of the housing part is greater than or equal to an outer diameter of the duct body to form a housing cavity in the housing part, and one end of the third air inlet of the bent tube is accommodated in the housing cavity.

Further, a clamping groove is arranged at one end of the third air inlet of the bent tube, an engagement part is arranged on a side of the housing assembly close to the bent tube, the engagement part is accommodated in the clamping groove and capable of sliding along the clamping groove to connect the bent tube with the housing assembly and enable the bent tube to be capable of rotating relative to the housing assembly.

Further, the housing part is accommodated in the housing assembly and is located on an inner side of the engagement part, and an angle at which the bent tube rotates relative to the housing assembly is greater than or equal to 90°.

Further, the axial flow blower further includes a power supply assembly arranged in the housing assembly. The power supply assembly comprises a battery pack and a circuit board located below the battery pack, a first heat dissipation hole communicated with the first air inlet is opened on a side wall of the first air inlet tube, and the first heat dissipation hole is arranged corresponding to the circuit board to dissipate heat generated by the circuit board during operation through the first heat dissipation hole.

Further, a second heat dissipation hole communicated with the first air inlet is further arranged on a top wall of the first air inlet tube, the housing assembly is provided with a battery pack cavity to accommodate the battery pack, a bottom of the battery pack cavity is communicated with the second heat dissipation hole, and a top of the battery pack cavity is provided with a third heat dissipation hole communicated with an outside.

Further, the housing assembly further comprises a fan arranged close to the third heat dissipation hole, after the fan is started, and the fan is configured to drive air flow entering the first air inlet tube from the first air inlet to enter the battery pack cavity through the second heat dissipation hole, and then drive the air flow to flow out from the third heat dissipation hole to take away heat in the battery pack cavity.

Further, a noise reduction sponge is arranged on an inner side wall of the first air inlet tube to reduce noise during air inlet, another noise reduction sponge is further arranged on an inner side wall of the bellow tube to reduce noise during air outlet, and a thickness of each of the noise reduction sponge is greater than or equal to 4 mm.

Further, the air inlet assembly comprises a window and a second air inlet tube connected with the window, the second air inlet tube is connected with the duct body, an air inlet is opened on the window, and when a power of the axial flow blower is greater than 2000 W, an air inlet area of the window is greater than or equal to 11000 cubic millimeters.

Further, the axial flow blower is a backpack blower or a handheld blower.

Beneficial effects of one or more embodiments of the disclosure are as follows: the axial flow blower sets the diameter of the fan blades to be from 64 mm to 100 mm and the diameter of the motor to be from 30 mm to 50 mm at the same time, so that the power of the axial flow blower can be greater than or equal to 2000 W and the blowing force is greater than or equal to 2500 g, thereby achieving a high power and a high blowing force, which may fully compete with gasoline blowers and improve the market advantages.

DETAILED DESCRIPTION

In order to enable objectives, technical solutions and advantages of the disclosure to be clearer, the disclosure is described in detail below with reference to accompanying drawings and specific embodiments.

The disclosure provides an axial flow blower. The axial flow blower may be designed in a backpack style to form a backpack blower, or in a handheld style to form a handheld blower, which is not limited here. For a convenience of description, the following will first take a backpack blower as an example and describe in detail a specific structure of the axial flow blower of the disclosure in conjunction with the accompanying drawings, which is not limited here.

Figure 1:
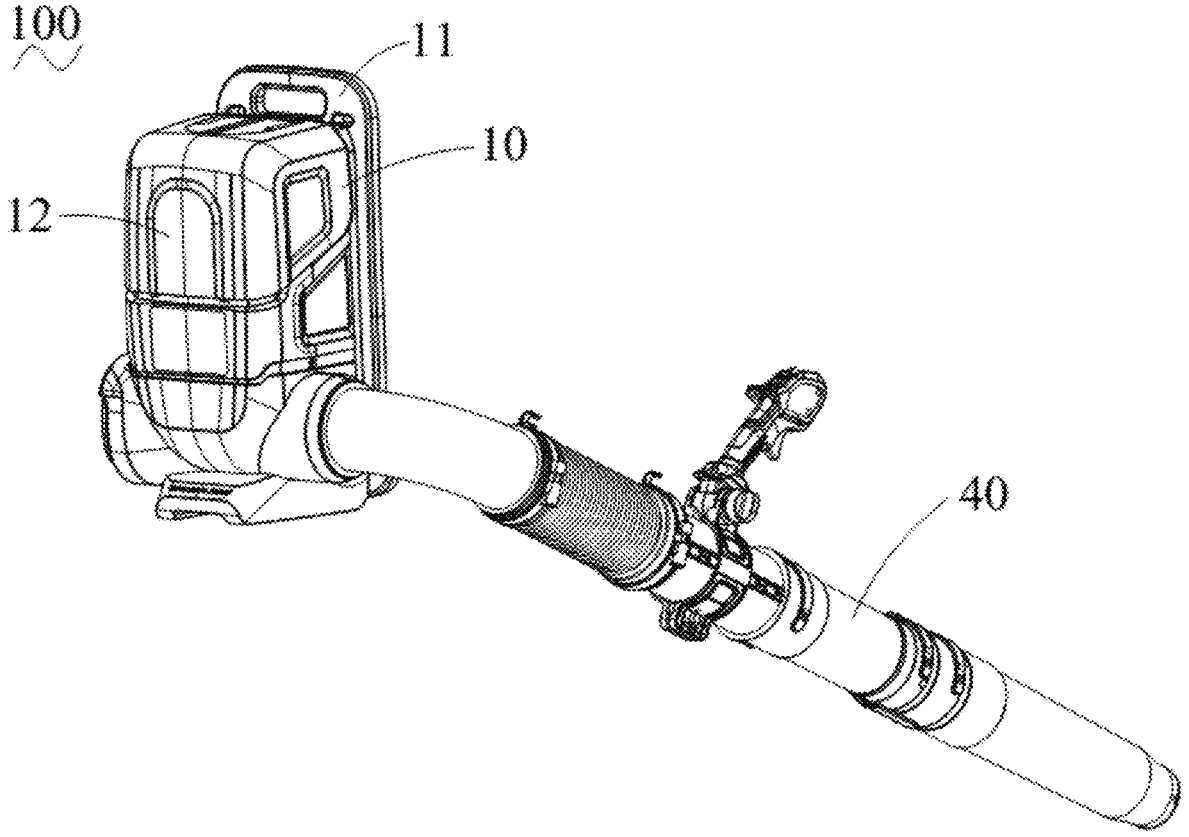
FIG. 1 is a perspective view of an axial flow blower according to at least one embodiment of the disclosure.
Figure 2:
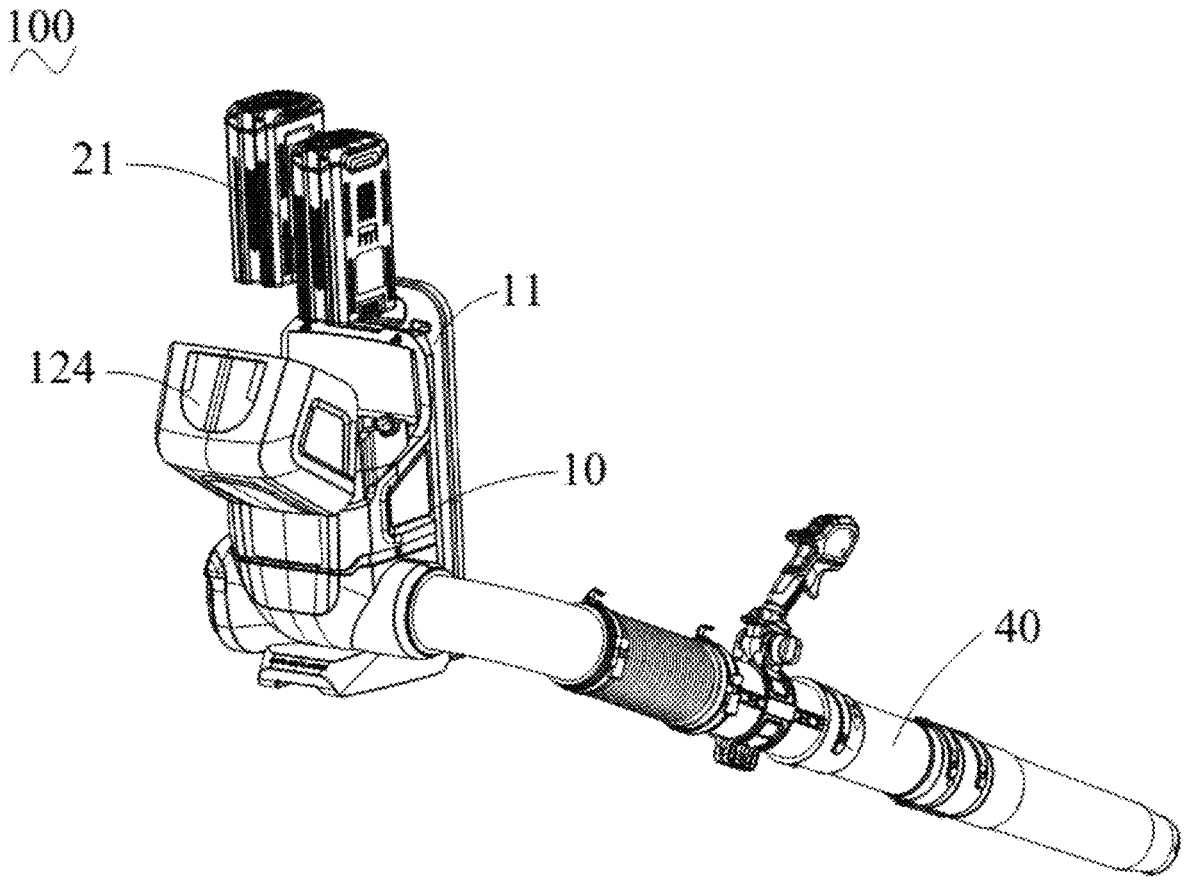
FIG. 2 is a schematic view of the axial flow blower in FIG. 1 after a battery pack is disassembled according to at least one embodiment of the disclosure.
Figure 3:
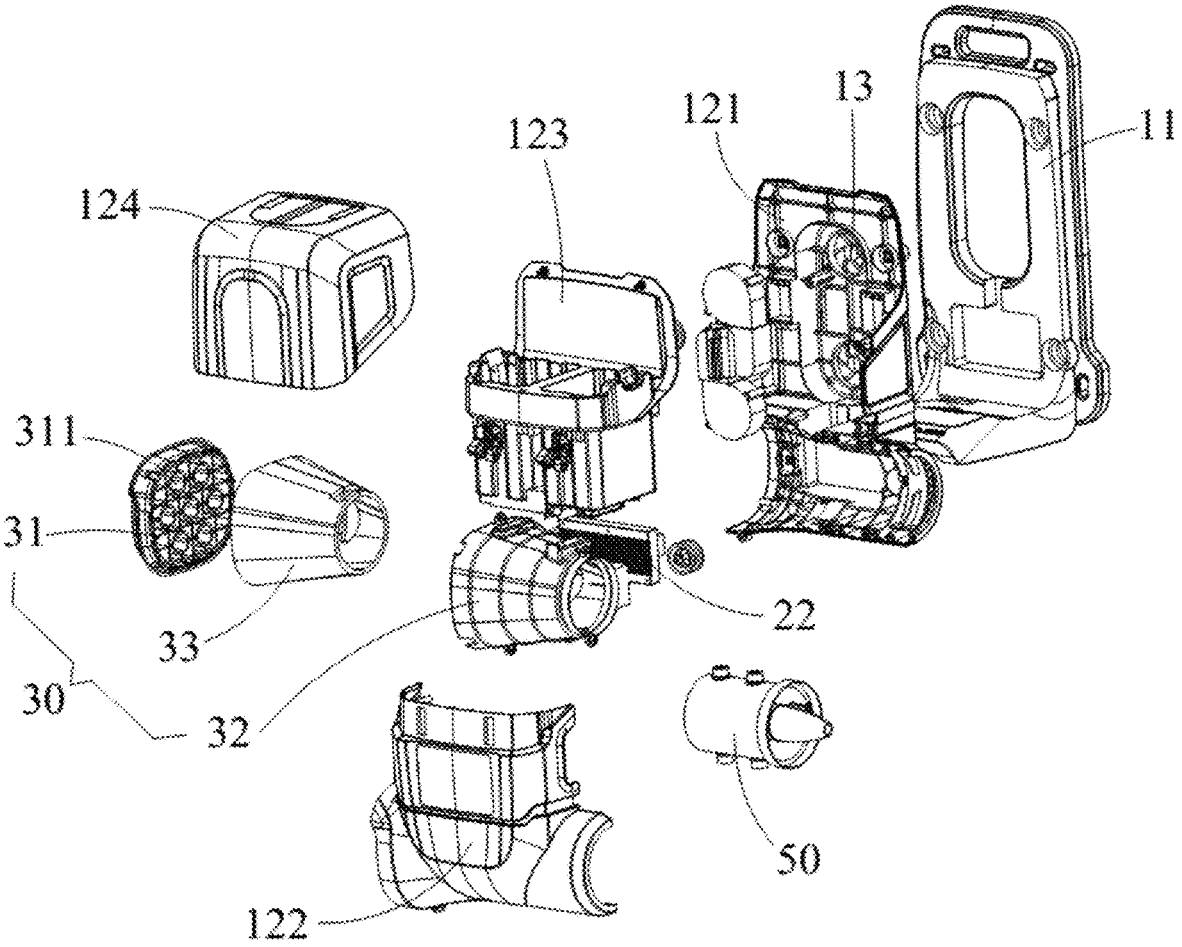
FIG. 3 is an exploded view of the axial flow blower in FIG. 1 after removing an air outlet assembly and the battery pack according to at least one embodiment of the disclosure.

Please refer to FIG. 1 through FIG. 3. The axial flow blower 100 includes a housing assembly 10, a power supply assembly (not labeled) assembled in the housing assembly 10, an air inlet assembly 30 assembled and connected with the housing assembly 10, an air outlet assembly 40, and a motor duct assembly 50 connected between the air inlet assembly 30 and the air outlet assembly 40.

The housing assembly 10 includes a back plate 11, a strap (not shown), and a housing 12 assembled with the back plate 11. The housing 12 is assembled and fixed to a first side wall of the back plate 11, and the strap is arranged on a second side wall of the back plate 11. When the strap is wrapped around an operator's body, the second side wall of the back plate 11 fits against the operator's back. The housing 12 includes a rear cover 121 fitted with the back plate 11, a front cover 122 assembled and fixed to the rear cover 121, a battery pack cavity 123 accommodated in an accommodating space enclosed and formed by the rear cover 121 and the front cover 122, and an upper cover 124 assembled and fixed to the front cover 122 to cover the battery pack cavity 123.

The power supply assembly is accommodated in the battery pack cavity 123, and is used to supply power for a motor 52 described below. The power supply assembly is carried on a back of a human body through the housing assembly 10, and includes a battery pack 21 and a circuit board 22 located below the battery pack 21. The circuit board 22 is electrically connected with the motor 52 and the battery pack 21. Electrical energy output by the battery pack 21 is transmitted to the circuit board 22 and then to the motor 52. The battery pack 21 is detachably inserted into the battery pack cavity 123 by sliding. In this embodiment, there are two battery packs 21 and the two battery packs 21 are connected in parallel. There are also two corresponding battery pack cavities 123 to accommodate the two battery packs 21, which is not limited here.

Figure 4:
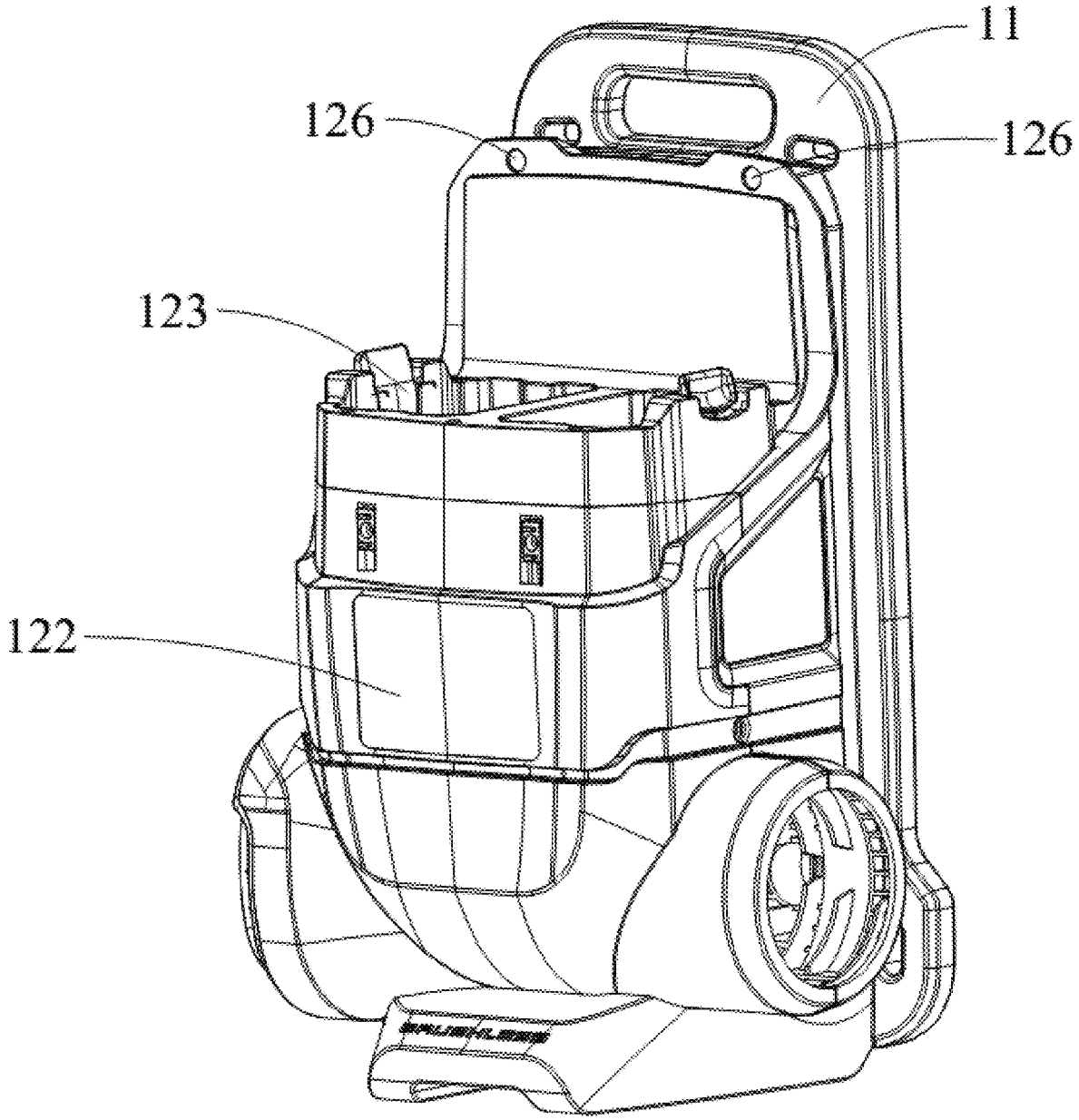
FIG. 4 is a perspective schematic view of a housing assembly after removing an upper cover and the battery pack according to at least one embodiment of the disclosure.

Please refer to FIG. 4. The upper cover 124 is pivotally connected with the front cover 122, so that the battery pack 21 may be installed into the corresponding battery pack cavity 123 through opening the upper cover 124. When the battery pack 21 is installed, the upper cover 124 may be closed to ensure that no dust and water enter the battery pack cavity 123, thereby achieving a dust-proof and waterproof effect. In order to realize an automatic closing of the upper cover 124, a torsion spring may be added at a rotating shaft to realize an automatic recovery of the upper cover 124, and two magnets 126 may be added to the battery pack cavity 123 to ensure that the upper cover 124 is closed firmly.

In a technical solution of the disclosure, the two battery packs 21 are arranged in parallel with each other to discharge. At the same time, weights of the two battery packs 21 are set to a ratio greater than or equal to 30% of the weight of the axial flow blower 100, thereby increasing an overall capacity of the axial flow blower 100.

Figure 5:
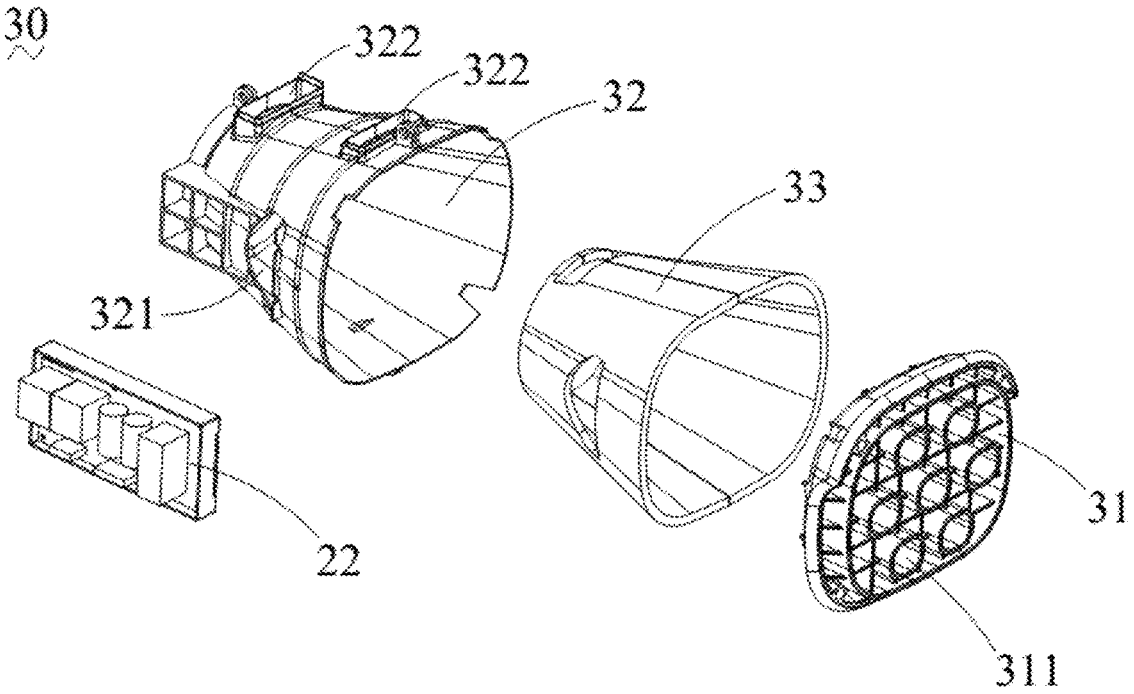
FIG. 5 is an exploded view of an air inlet assembly in FIG. 3 according to at least one embodiment of the disclosure.
Figure 6:
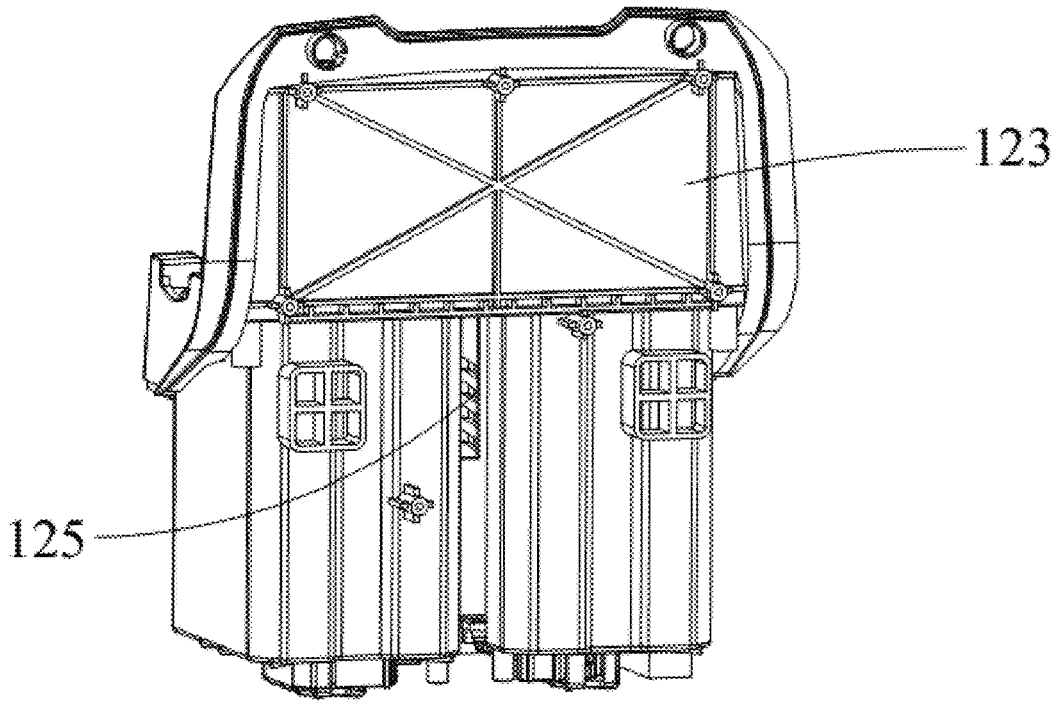
FIG. 6 is a perspective view of a battery pack cavity in FIG. 3 according to at least one embodiment of the disclosure.

Please refer to FIG. 5 and FIG. 6 in conjunction with FIG. 3. The air inlet assembly 30 is arranged below the power supply assembly, and includes a window 31 and a second first air inlet tube 32 assembled and fixed with the window 31. The window 31 is provided with a first air inlet 311, the first air inlet 311 is communicated with an inner cavity of the first air inlet tube 32 to form a complete air inlet passage. When a total power of the axial flow blower 100 is greater than 2000 W, an effective air inlet area of the window 31 is greater than or equal to 11000 cubic millimeters to ensure an air inlet volume.

In order to reduce noise during air inlet, a noise reduction sponge 33 is arranged on an inner side wall of the first air inlet tube 32, and a thickness of the noise reduction sponge 33 is greater than or equal to 4 mm. A first heat dissipation hole 321 is opened on a side wall of the first air inlet tube 32. The first heat dissipation hole 321 is arranged corresponding to the circuit board 22 to increase air flow at a position of the circuit board 22, so that heat generated during an operation of the circuit board 22 may be dissipated through the first heat dissipation hole 321, thereby reducing a temperature of the circuit board 22.

A second heat dissipation hole 322 is formed on a top wall of the first air inlet tube 32, a bottom of the battery pack cavity 123 is communicated with the second heat dissipation hole 322, and a third heat dissipation hole 125 communicated with an outside is formed on a top of the battery pack cavity 123. The housing assembly 10 further includes a fan 13 arranged near the third heat dissipation hole 125. When the fan 13 is started, it can drive the air flow entering the first air inlet tube 32 from the first air inlet 311 to first enter the battery pack cavity 123 through the second heat dissipation hole 322, and then flow out from the third heat dissipation hole 125 from bottom to top in the battery pack cavity 123, taking away the heat in the battery pack cavity 123. In some embodiments, the fan 13 is fixed on the back plate 11.

In other words, through arranging the first heat dissipation hole 321 on the side wall of the first air inlet tube 32, when the axial flow blower 100 is running, the circuit board 22 may be cooled through the first air inlet 311 and the first heat dissipation hole 321, thereby extending a running time of the circuit board 22. Through arranging the second heat dissipation hole 322 on the top wall of the first air inlet tube 32 and at the same time arranging the third heat dissipation hole 125 on the top of the battery pack cavity 123, when the axial flow blower 100 is running, a heat dissipation passage may be formed in the battery pack cavity 123 through the second heat dissipation hole 322 and the third heat dissipation hole 125 to dissipate the heat of the battery pack 21. Through arranging the fan 13 on the back plate 11, the fan 13 may be used to extract the heat from the battery pack cavity 123 through the third heat dissipation hole 125, thereby achieving cooling and heat dissipation, and extending a running time of the battery pack 21.

Figure 7:
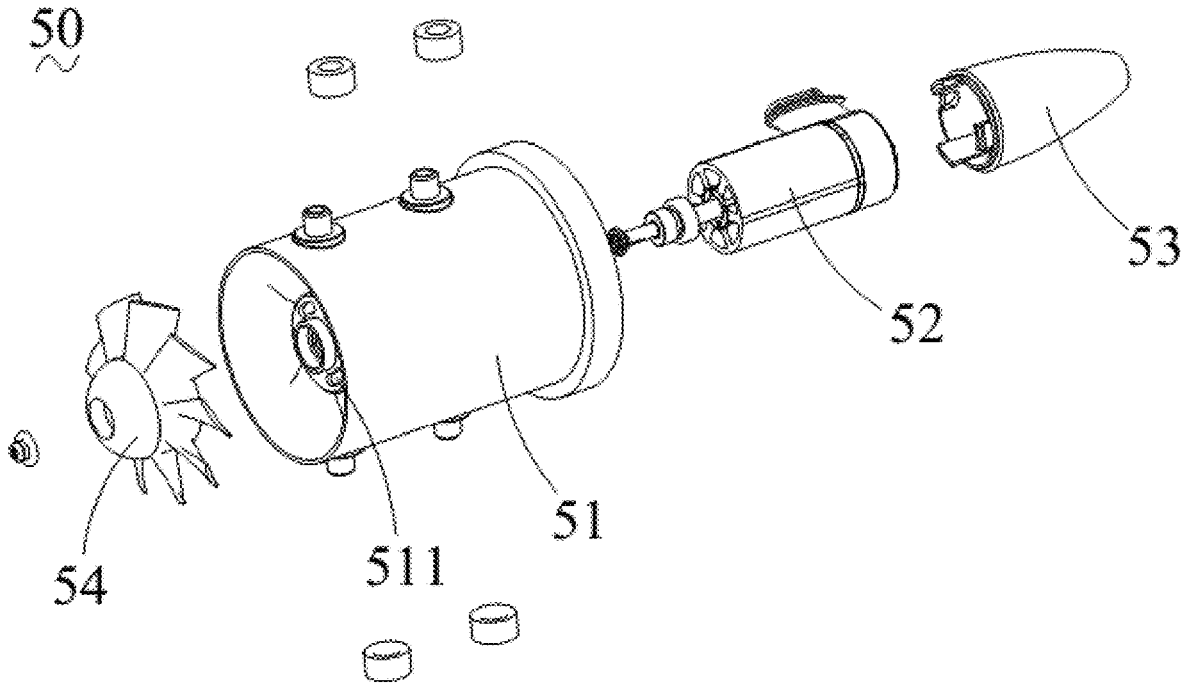
FIG. 7 is an exploded view of a motor duct assembly in FIG. 3 according to at least one embodiment of the disclosure.
Figure 8:
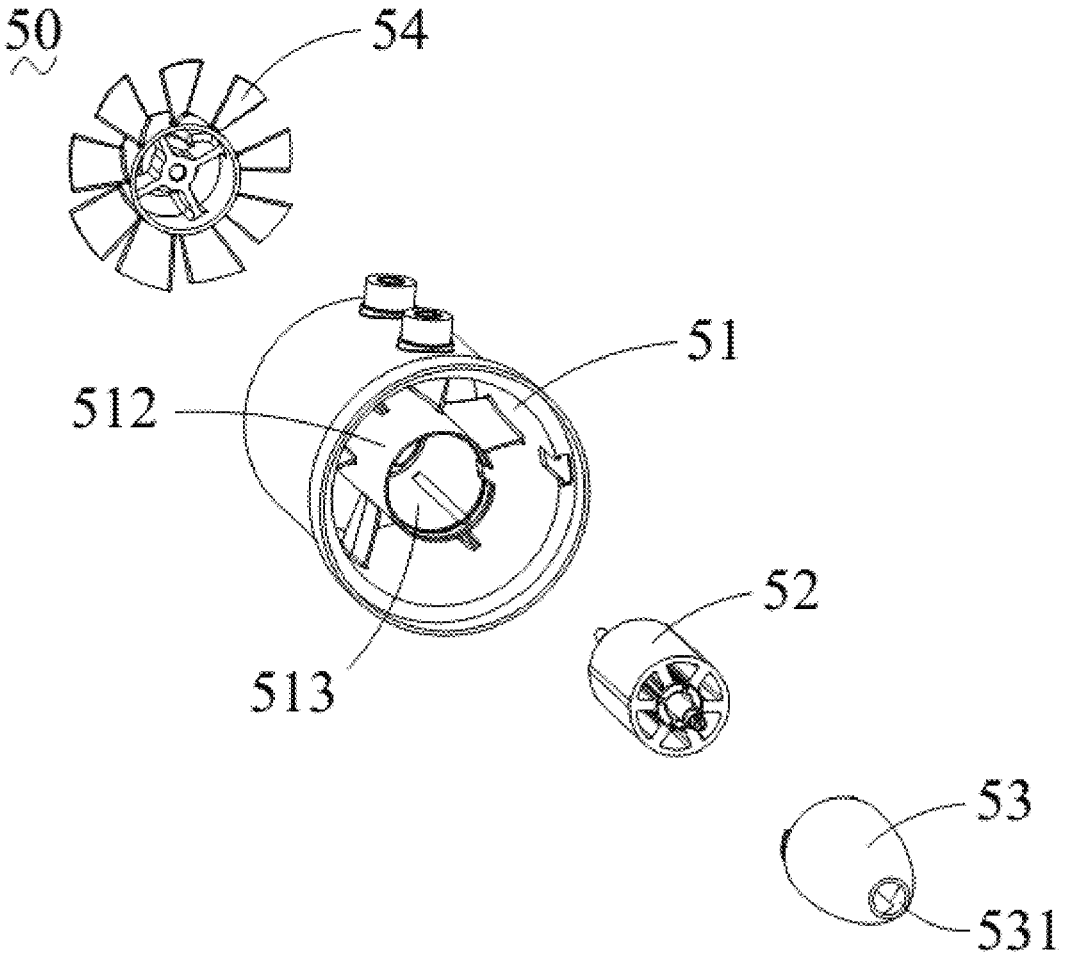
FIG. 8 is a schematic view of FIG. 7 from another angle.

Please refer to FIG. 7 and FIG. 8 in conjunction with FIG. 3. The motor duct assembly 50 is connected between the air inlet assembly 30 and the air outlet assembly 40, and is powered by the power supply assembly. The motor duct assembly 50 includes a duct body 51, a motor 52 fixed inside the duct body 51, a guiding cone 53 installed and matched with a first end of the duct body 51, and a fan blade 54 installed and matched with a second end of the duct body 51. The second end of the duct body 51 where the fan blade 54 is installed is connected with the first air inlet tube 32, and the first end of the duct body 51 where the guiding cone 53 is installed is connected with the air outlet assembly 40. The fan blade 54 is fixed on a motor shaft of the motor 52. With this arrangement, when the motor 52 is started, the fan blade 54 is driven to rotate, and a negative pressure is generated at the first air inlet 311, so that external air enters the first air inlet tube 32 through the first air inlet 311, flows to the motor duct assembly 50, and then flows out along the air outlet assembly 40 under an action of the guiding cone 53.

In an embodiment, a second air inlet 511 is arranged on a side of the duct body 51 close to the fan blade 54, a first air outlet 531 is arranged on a side of the guiding cone 53 away from the fan blade 54, and the second air inlet 511 is communicated with the first air outlet 531 to form an air flow passage in the duct body 51, so that the negative pressure generated at the first air inlet 311 can enter the air flow passage through the second air inlet 511 and then flow out from the first air outlet 531 to reduce a temperature of the motor 52. In some embodiments, the duct body 51 is provided with an accommodating part 512 to accommodate the motor 52, an accommodating cavity 513 is formed in the accommodating part 512, the motor 52 is accommodated in the accommodating cavity 513, the second air inlet 511 is arranged on a side of the accommodating part 512 close to the fan blade 54, and the air flow passage passes through the motor 52 and the accommodating cavity 513 from the second air inlet 511 to reach the first air outlet 531.

In order to enhance a blowing force of the axial flow blower 100, a diameter of the fan blade 54 is set to be between 64 mm and 100 mm, and sets a diameter of the motor 52 to be between 30 mm and 50 mm at the same time, so that a power of the axial flow blower 100 can be greater than or equal to 2000 W and the blowing force can be greater than or equal to 2500 g. For example, as shown in a following table, when the diameter of the fan blade 54 is selected to be 89 mm, under same conditions, a rotating speed of the motor 52 may reach 34220 rpm, the power of the axial flow blower 100 can reach 2500 W, an air speed may reach 210 MPH, an air volume may reach 718 CFM, and the blowing force may reach 3215 g, which is completely comparable to performances of a gasoline blower.

| Diameter of the fan blade | Power (W) | Rotating speed (RPM) | Air speed (mph) | Air volume (cfm) | Blowing force (g) |
|---|---|---|---|---|---|
| Φ89 mm | 2500 | 34220 | 210 | 718 | 3215 |

In addition, through replacing materials of the duct body 51 and the fan blade 54 with a low-density metal with a density less than or equal to 6.8 g/cm$^3$, such as magnesium alloy and aluminum alloy, a stability may be increased to ensure that a dynamic balance value of the fan blade 54 is from 2 mg to 20 mg.

Figure 9:
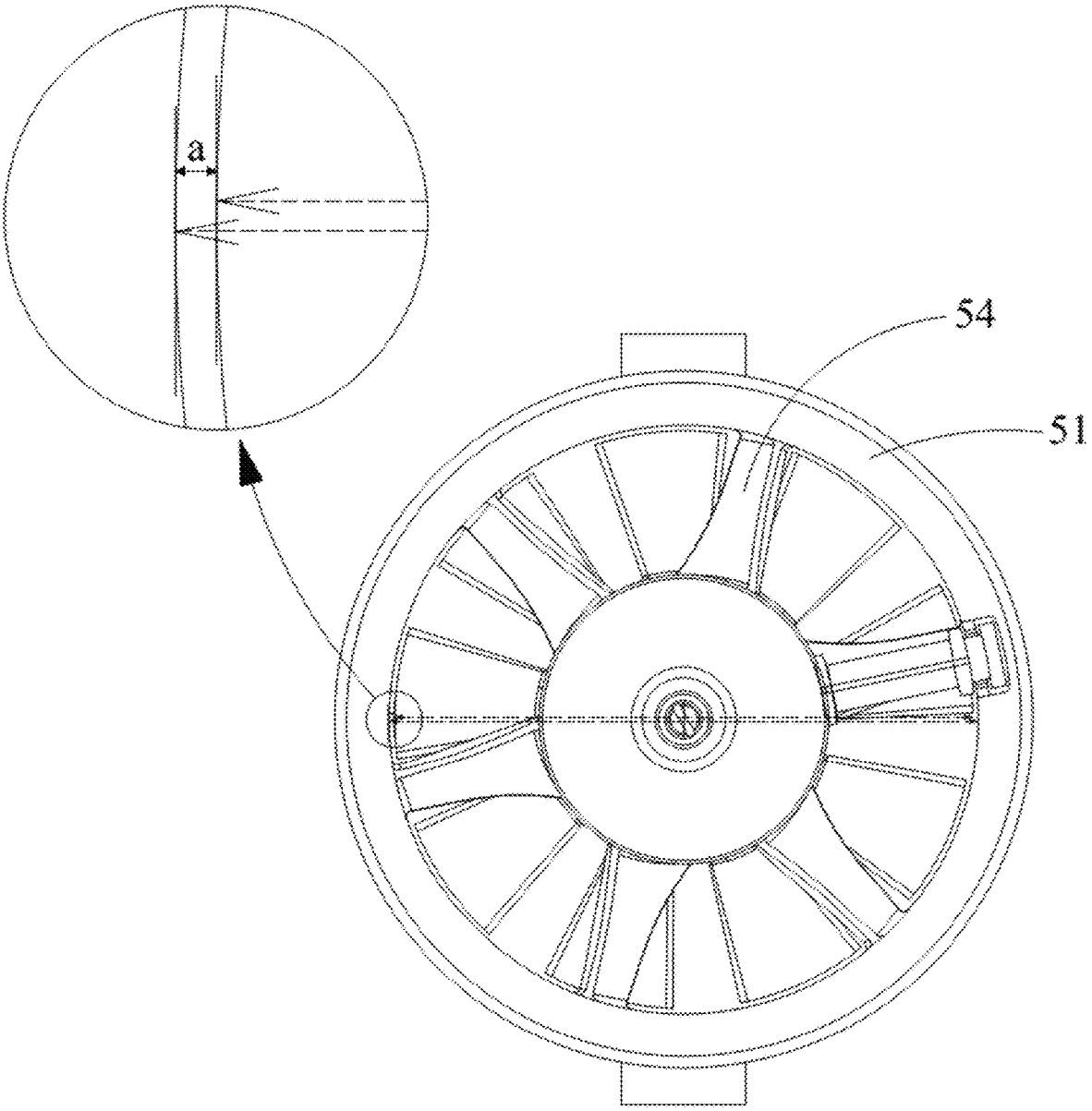
FIG. 9 is a side view of the motor duct assembly in FIG. 7 according to at least one embodiment of the disclosure.

Please refer to FIG. 9. The fan blade 54 is accommodated in the duct body 51, and a gap a is left between a tail end of the fan blade 54 and an inner wall surface of the duct body 51 in a radial direction of the fan blade. The gap a is less than or equal to 1.2 mm to reduce a performance loss during a rotation of the fan blade 54.

Figure 10:
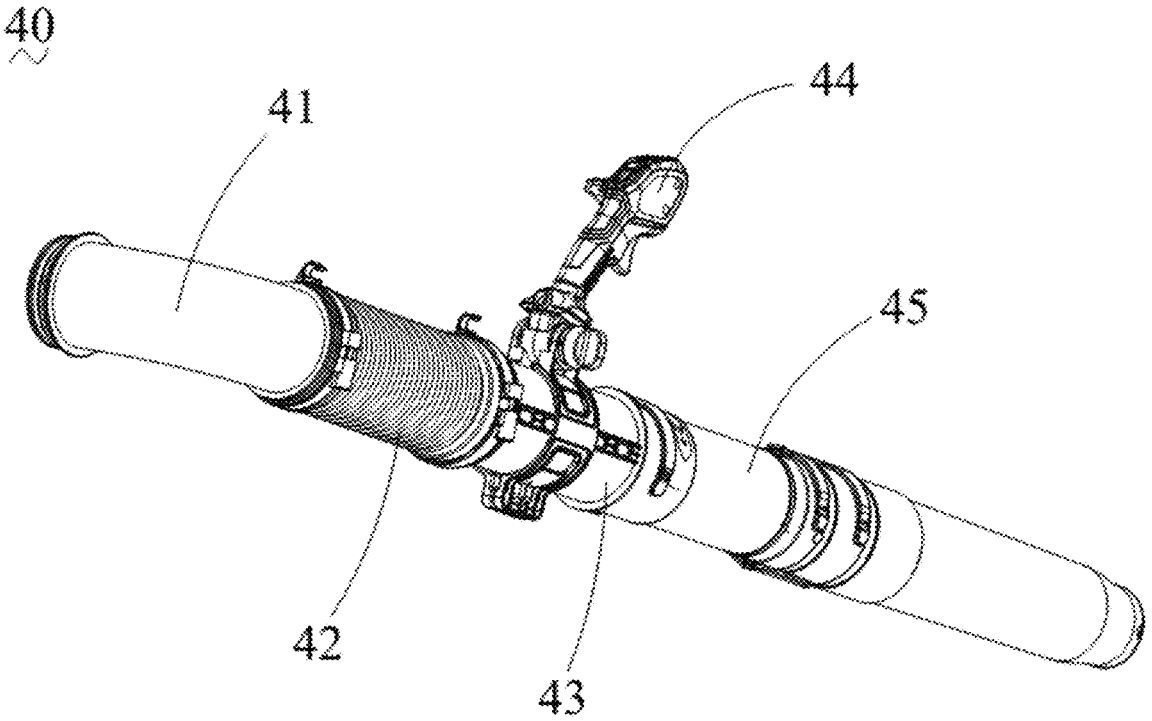
FIG. 10 is a perspective view of the air outlet assembly in FIG. 3 according to at least one embodiment of the disclosure.
Figure 16:
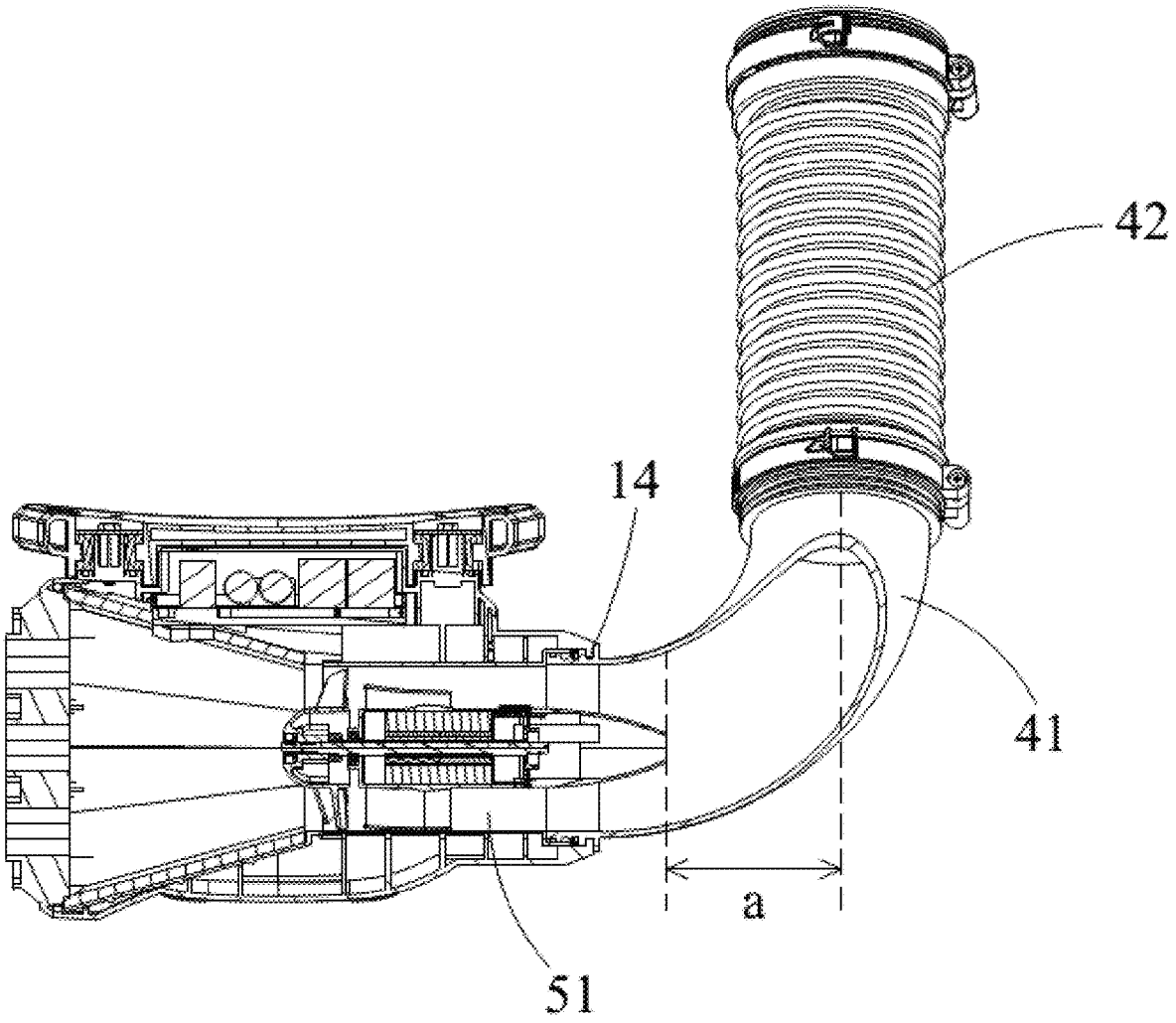
FIG. 16 is a partial cross-sectional view of the rear cover, the air inlet assembly, the motor duct assembly, the bent tube and a bellow tube according to at least one embodiment of the disclosure.
Figure 17:
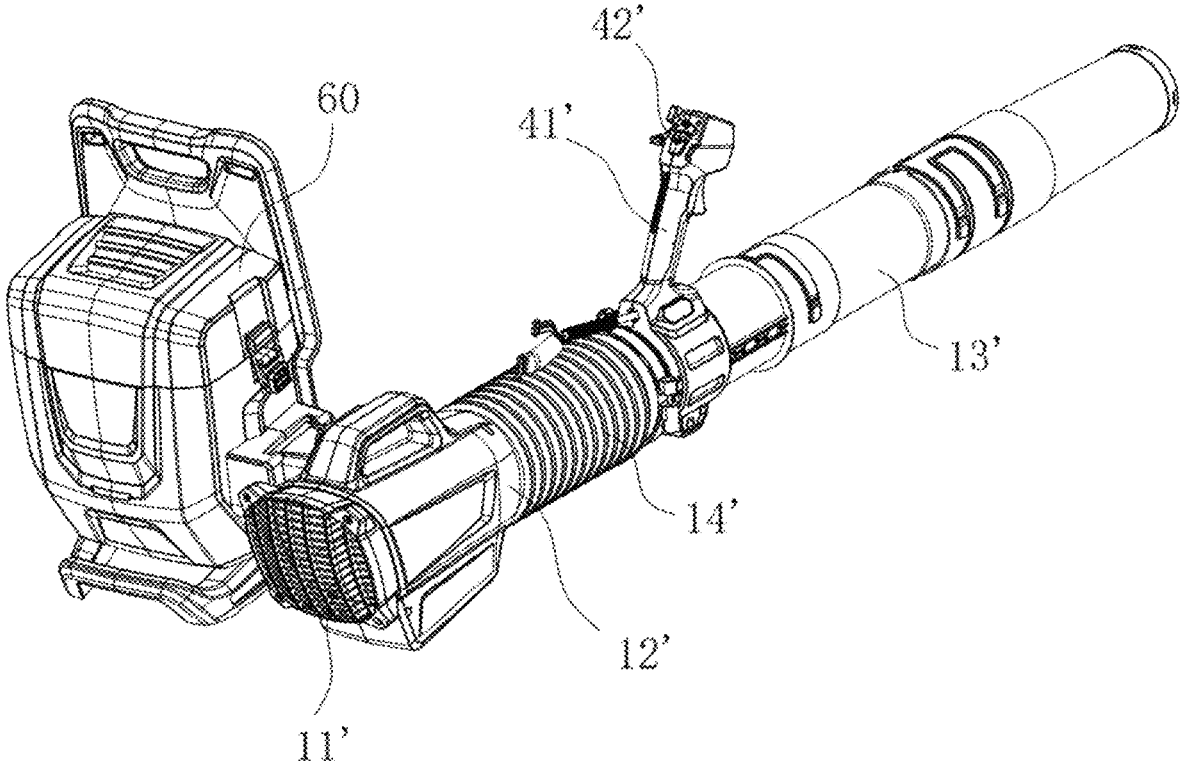
FIG. 17 is a perspective view of a backpack blower of the disclosure according to at least one embodiment of the disclosure.
Figure 18:
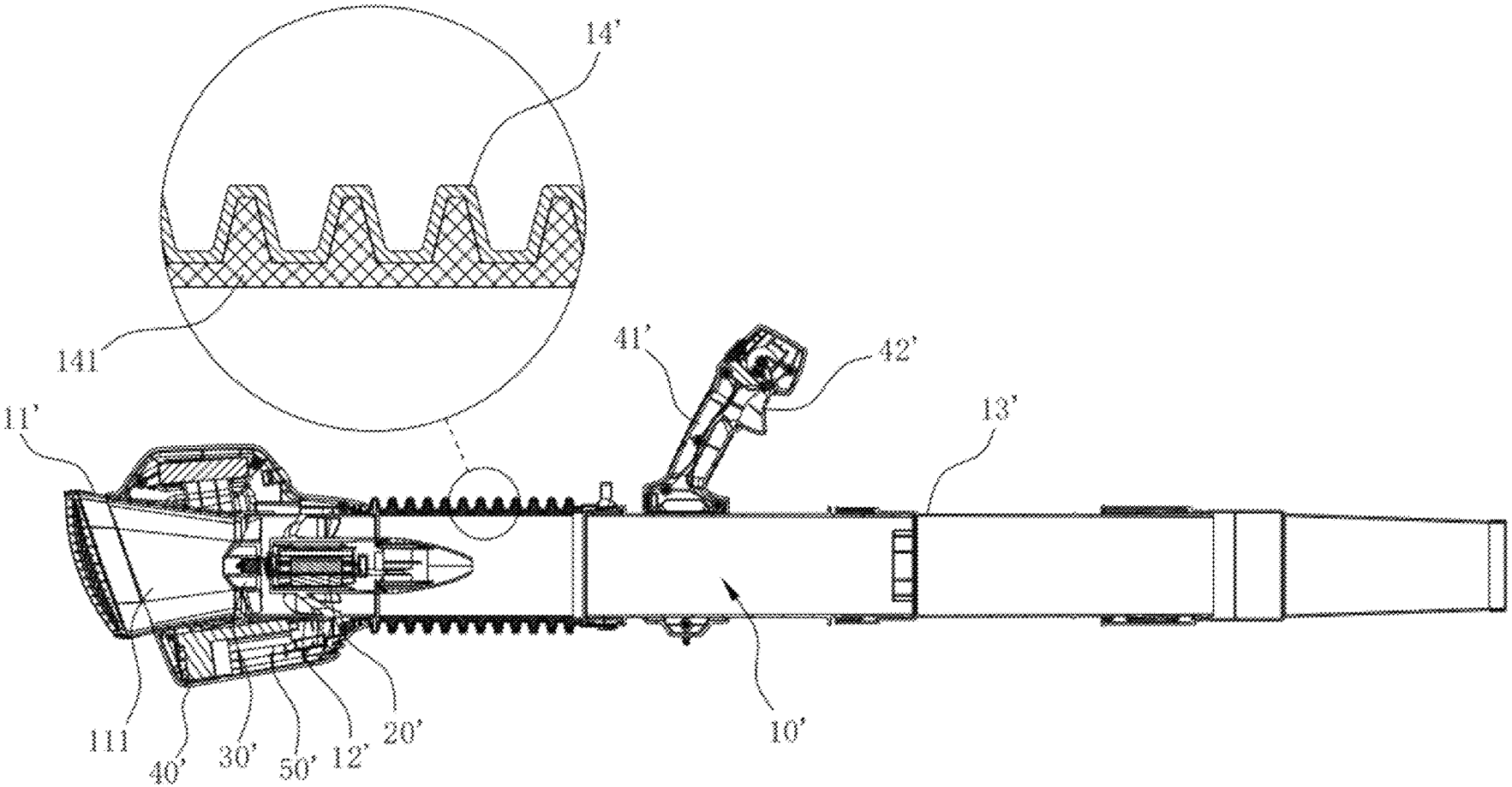
FIG. 18 is a cross-sectional view of the backpack blower in FIG. 17 according to at least one embodiment of the disclosure.
Figure 19:
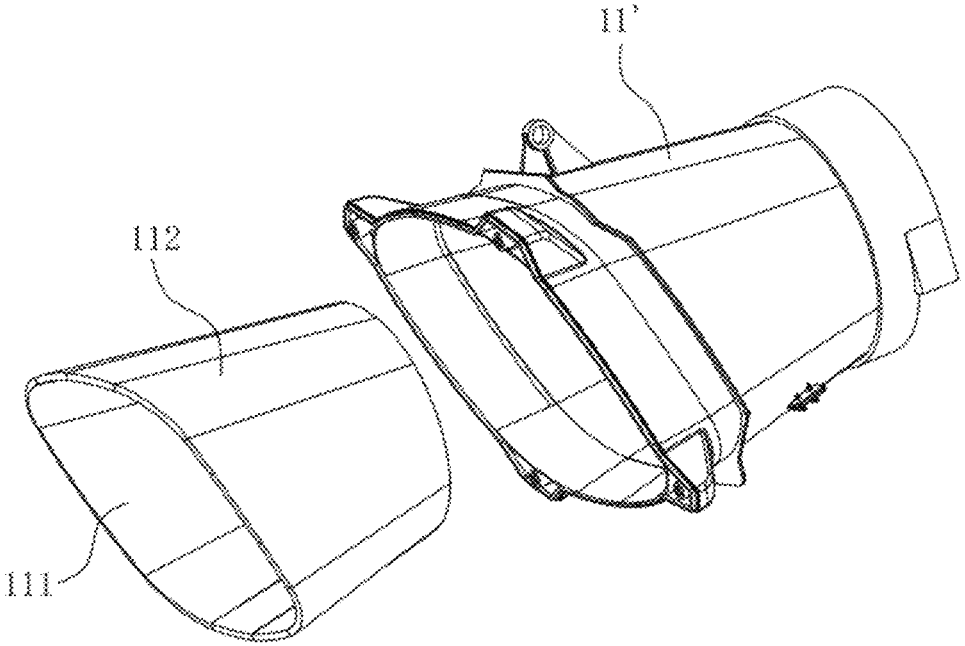
FIG. 19 is an exploded view of an air inlet tube in FIG. 17 according to at least one embodiment of the disclosure.
Figure 20:
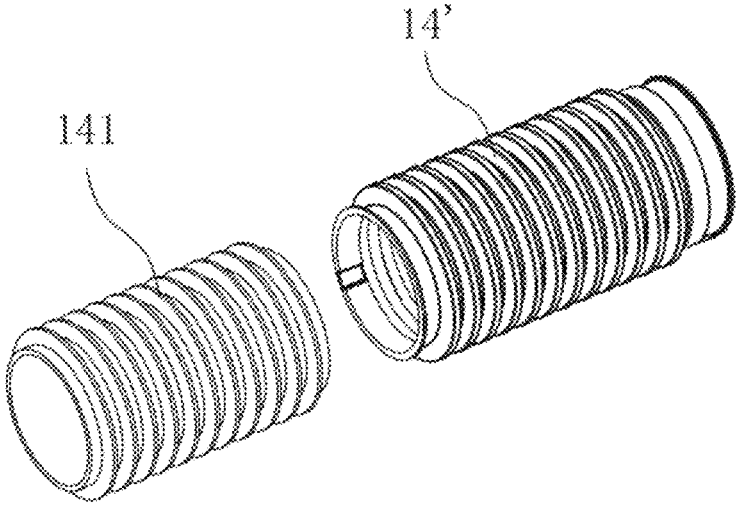
FIG. 20 is an exploded view of the bellow tube in FIG. 17 according to at least one embodiment of the disclosure.
Figure 21:
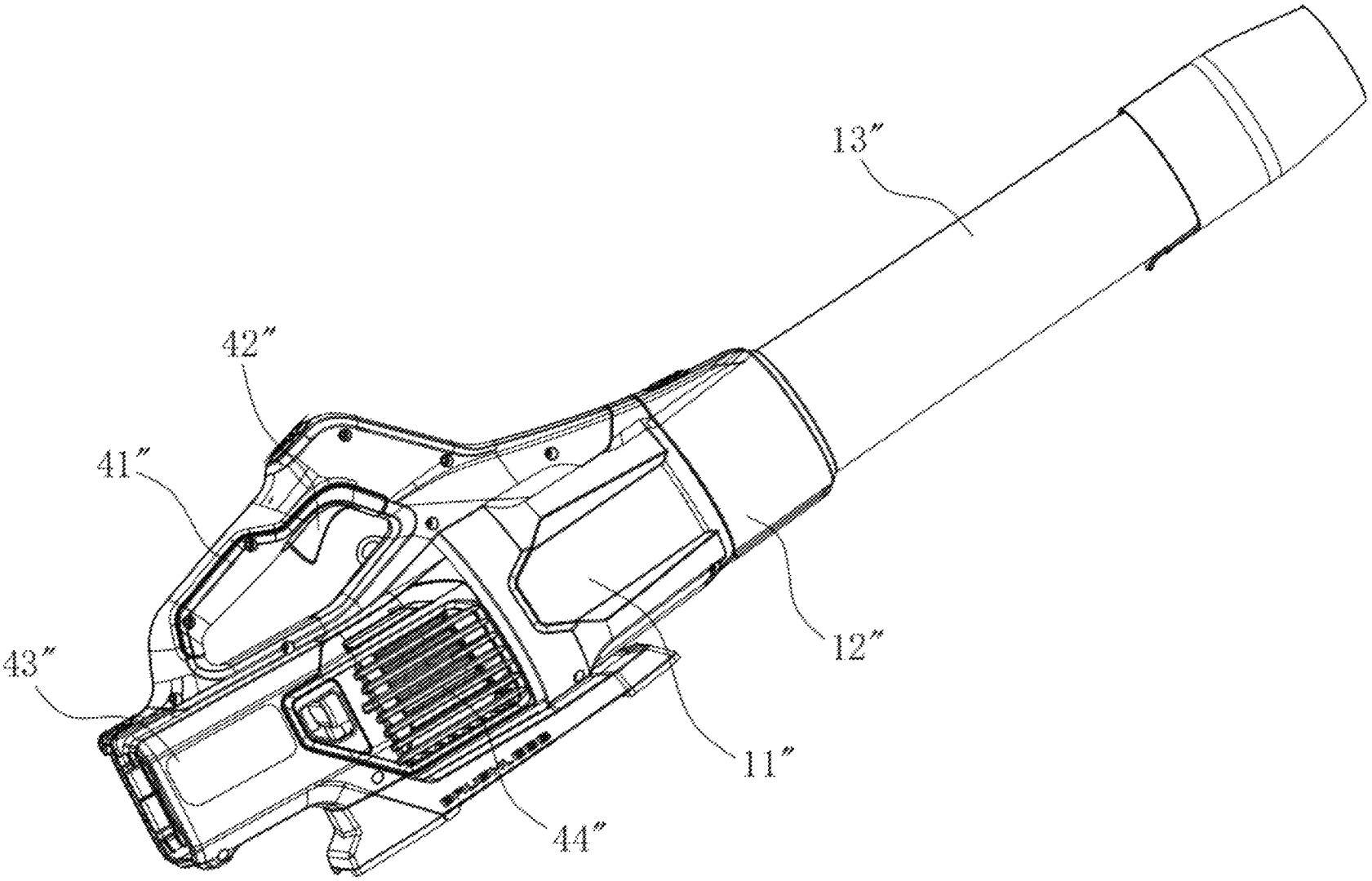
FIG. 21 is a perspective view of a handheld blower according to at least one embodiment of the disclosure.

Please refer to FIG. 10 and FIG. 16 in conjunction with FIG. 3. The air outlet assembly 40 includes a bent tube 41, a bellow tube 42 fixedly connected with the bent tube 41, an air outlet tube 43 fixedly connected with the bellow tube 42, a handle assembly 44 installed on the air outlet tube 43, and a blowing tube 45 connected with the air outlet tube 43. The bent tube 41 is connected with the duct body 51, and is used to guide the air flow flowing out through the duct body 51 into the air outlet tube 43. The guiding cone 53 extends into the bent tube 41. A distance between a tail end port of the guiding cone 53 and a central axis of the second air outlet of the bent tube 41 is greater than or equal to 75 mm. In some embodiments, the central axis of the second air outlet of the bent tube 41 is on a same axis as a central axis of the bellow tube 42, and the distance a between the tail end port of the guiding cone 53 and the central axis of the second air outlet of the bent tube 41 is greater than or equal to 80 mm to reduce a blowing force loss and improve the performance.

Figure 13:
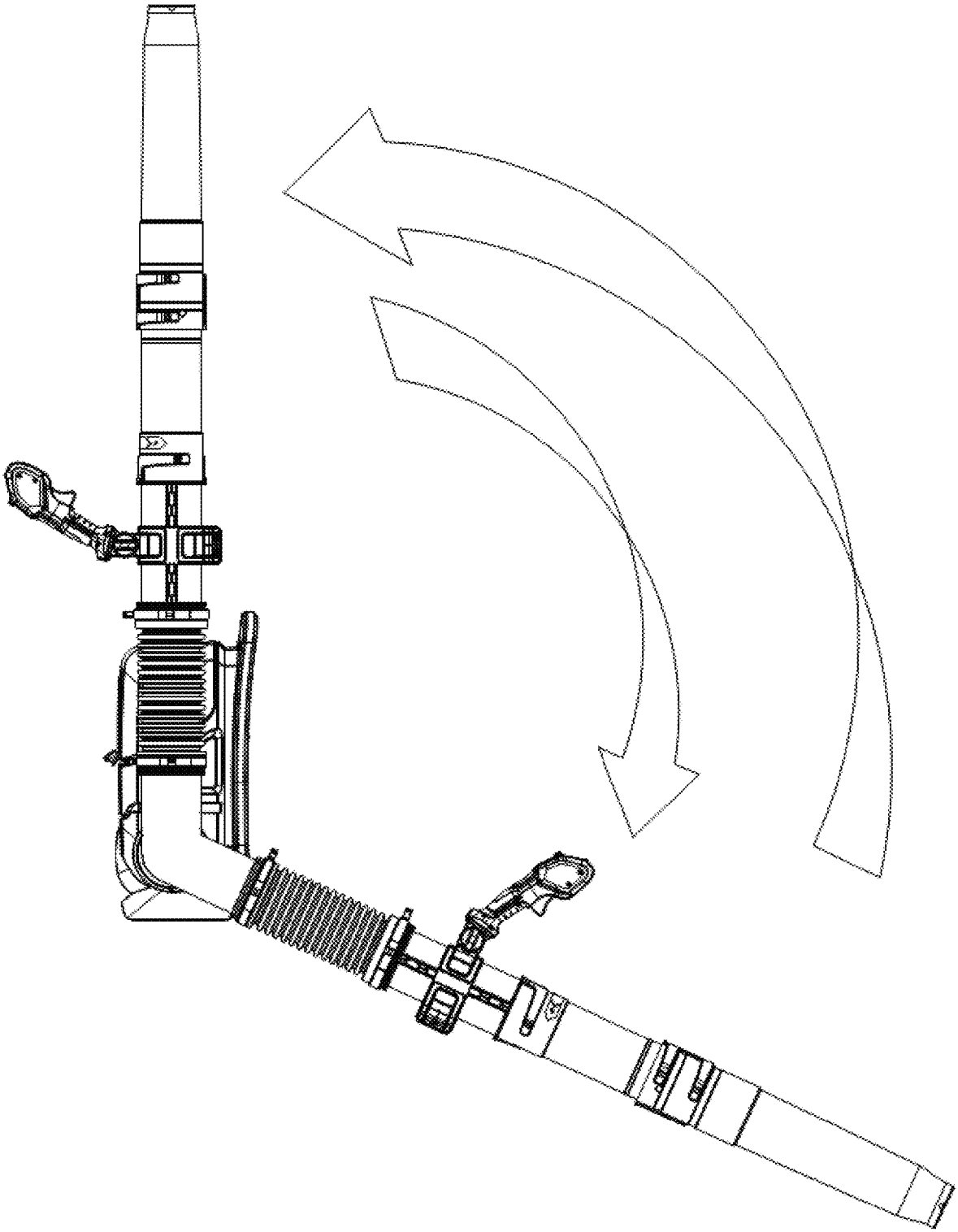
FIG. 13 is a perspective view of a state of the air outlet assembly of the axial flow blower when rotating according to at least one embodiment of the disclosure.

One end of a third air inlet of the bent tube 41 is inserted into the duct body 51 and movably connected with an end port of the duct body 51, and a central axis of the third air inlet of the bent tube 41 and a central axis of the duct body 51 are on the same axis, so that the bent tube 41 can rotate coaxially with the duct body 51, and a rotating angle is greater than or equal to 90°, which is convenient for the operator to adjust an angle of the air outlet assembly 40 and realize an operation in a wide range. Please refer to FIG. 13 for details.

Figure 14:
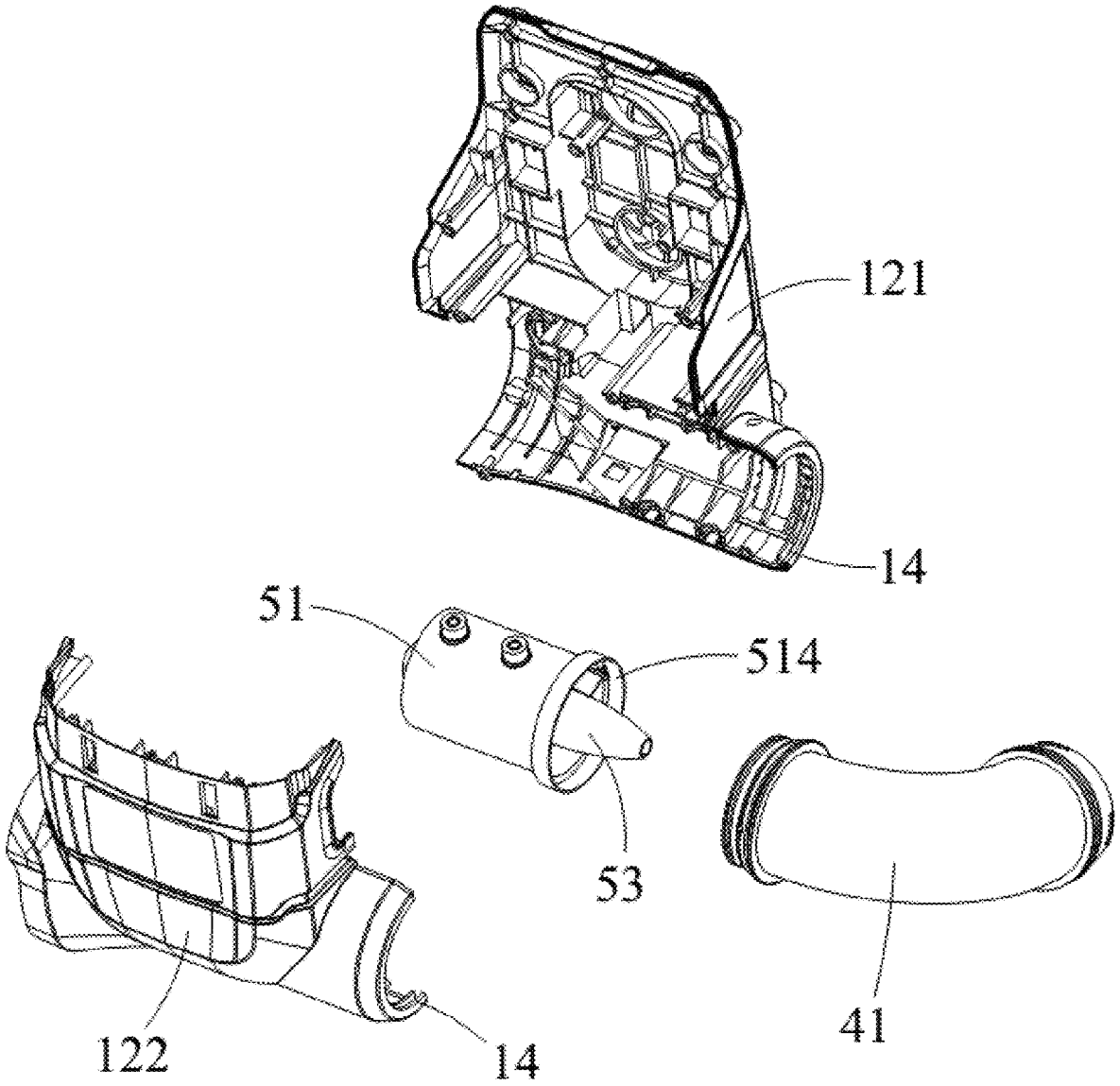
FIG. 14 is an exploded view of a front cover, a rear cover, the motor duct assembly and a bent tube according to at least one embodiment of the disclosure.
Figure 15:
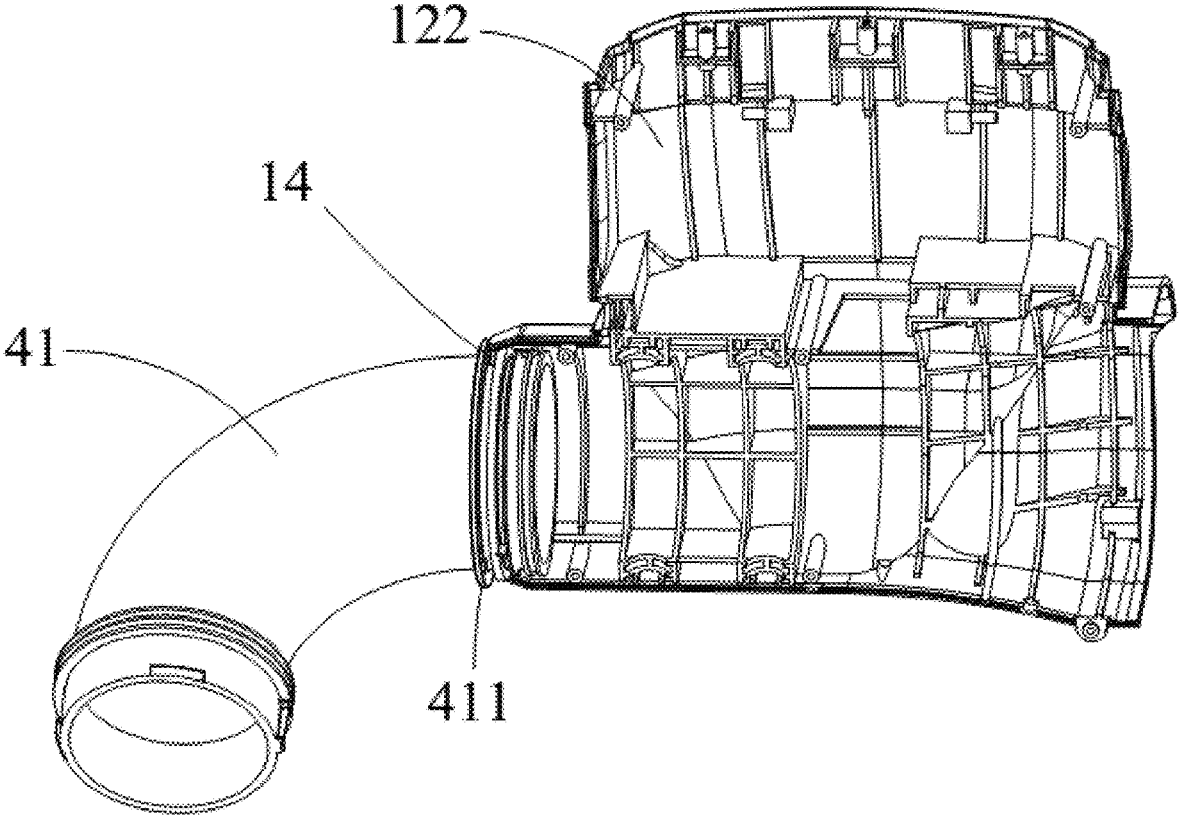
FIG. 15 is a view of an assembled state of the front cover and the bent tube in FIG. 14 according to at least one embodiment of the disclosure.

In an embodiment, please refer to FIG. 14 and FIG. 15, a housing part 514 is arranged at one end of the duct body 51 close to the bent tube 41, an inner diameter of the housing part 514 is greater than or equal to an outer diameter of the duct body 51 to form a housing cavity (not labeled) in the housing part 514, and one end of the third air inlet of the bent tube 41 is accommodated in the housing cavity. A clamping groove 411 is arranged at one end of the third air inlet of the bent tube 41, an engagement part 14 is arranged on a side of the housing assembly 10 close to the bent tube 41, the engagement part 14 is accommodated in the clamping groove 411 and capable of sliding along the clamping groove 411 to connect the bent tube 41 with the housing assembly 10 and enable the bent tube 41 to be capable of rotating relative to the housing assembly 10. In some embodiments, the housing part 514 is accommodated in the housing assembly 10 and is located on an inner side of the engagement part 14, and an angle at which the bent tube 41 rotates relative to the housing assembly 10 is greater than or equal to 90°.

In this embodiment, since the housing assembly 10 includes the front cover 122 and the rear cover 121, the engagement part 14 may be partially arranged on the front cover 122 and partially arranged on the rear cover 121. When the front cover 122 and the rear cover 121 are assembled, a complete circle of a protruding structure, which means a complete engagement part 14, may be formed. Such a design not only fixes the bent tube 41 to the front cover 122 and the rear cover 121 in a track manner to ensure that the bent tube 41 will not fall off, but also does not affect a rotation of the bent tube 41 relative to the duct body 51.

Of course, one end of the bent tube 41 is further designed to be respectively clamped and fixed with the front cover 122 and the rear cover 121, thereby ensuring that the bent tube 41 will not fall off and will not affect the rotation of the bent tube 41 relative to the duct body 51.

In order to reduce noise during air outlet, in some embodiments, a noise reduction sponge is arranged on an inner side wall of the bellow tube 42, and a thickness of the noise reduction sponge is greater than or equal to 4 mm to reduce noise during operation of a whole machine.

Figure 11:
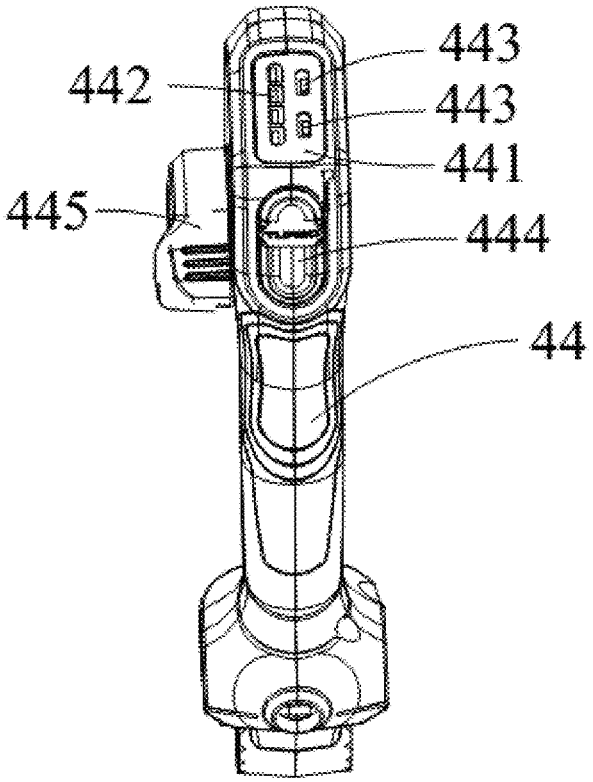
FIG. 11 is a perspective view of a handle assembly in FIG. 10 according to at least one embodiment of the disclosure.
Figure 12:
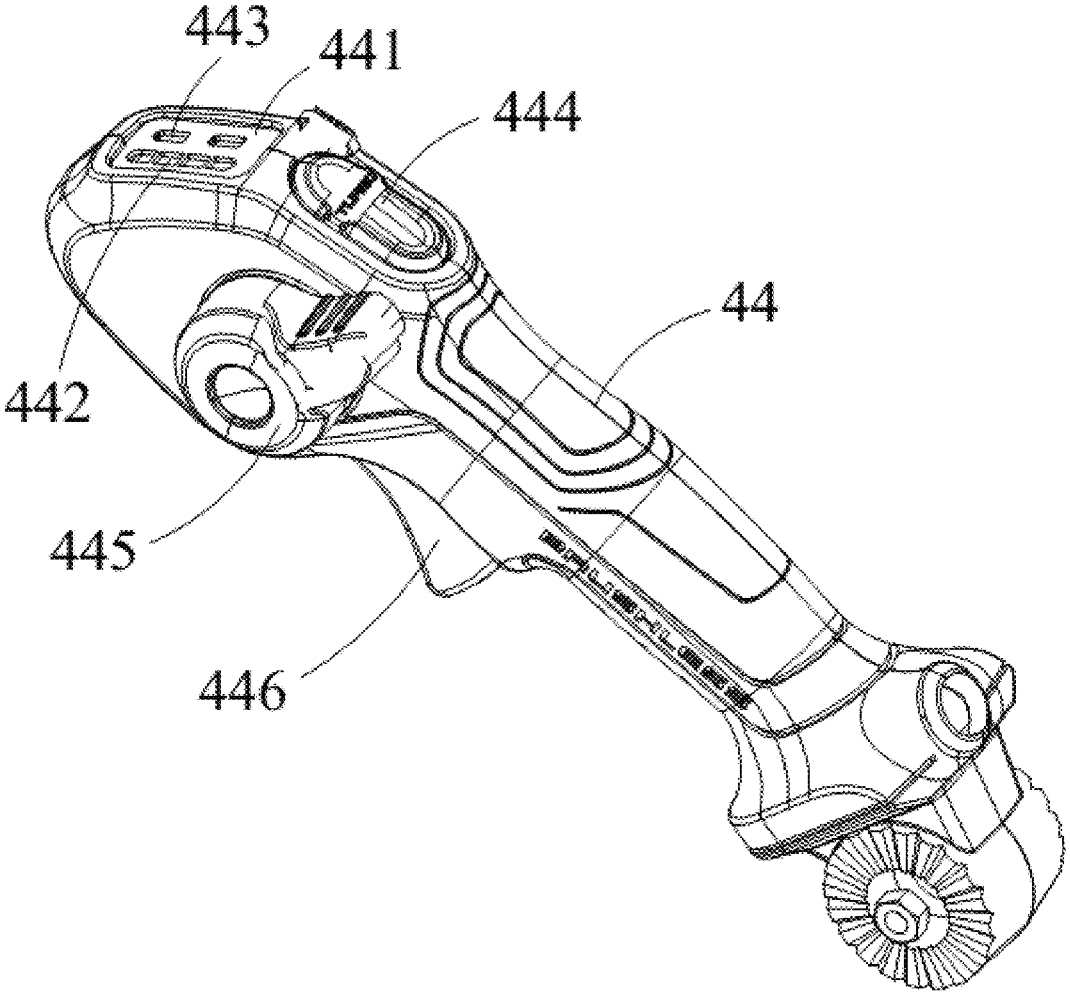
FIG. 12 is a perspective view of the handle assembly in FIG. 11 from another angle.

Please refer to FIG. 11 and FIG. 12. The handle assembly 44 is used for the operator to hold and start the axial flow blower 100. The handle assembly 44 is connected with the power supply assembly (specifically the circuit board 22) through a control wire, so as to achieve a normal starting of the axial flow blower 100. In this disclosure, since there are two battery packs 21, in order to allow the user to clearly know a current power of the battery pack 21, a display screen 441 is additionally arranged on the handle assembly 44. The display screen 441 is provided with a first display part 442 for displaying the current power of the battery pack 21 and a second display part 443 for displaying a number of battery packs 21. The first display part 442 is located on a left side of the second display part 443 and includes four display lights. The second display part 443 is located on a right side of the first display part 442 and includes two display lights.

When a single battery pack 21 is inserted into the battery pack cavity 123, the corresponding display light in the second display part 443 lights up, and the first display part 442 displays the current power of the single battery pack 21. When the two battery packs 21 are both inserted into the battery pack cavity 123, both display lights in the second display part 443 light up, and at this time the first display part 442 preferentially displays a power of the battery pack 21 with more power, and the battery pack 21 with more power is discharged preferentially. When the battery pack 21 with more power runs to a same power as the other battery pack 21, the two battery packs 21 will discharge at the same time to ensure an operating battery pack capacity of the axial flow blower 100.

The handle assembly 44 is further provided with an acceleration button 444, a constant speed button 445 and a switch trigger 446. Wherein, the display screen 441 is arranged at a top of the handle assembly 44 for the operator to directly view. The acceleration button 444 is arranged below the display screen 441 for the operator to operate with a thumb to achieve a multi-speed acceleration. The constant speed button 445 is arranged on a left side of the handle assembly 44, and the switch trigger 446 is arranged below the handle assembly 44 for the operator to hold and operate with four fingers. When in use, the switch trigger 446 is first pressed with four fingers to start the axial flow blower 100. Then, the acceleration button 444 is pressed to switch the axial flow blower 100 between different air speed gears. After the air speed gear is selected, a specific air speed is adjusted by pressing the switch trigger 446. Finally, the constant speed button 445 is turned to lock a current air speed. After releasing the constant speed button 445, the axial flow blower 100 can be fixed to work at the current air speed. After the work is completed, the axial flow blower 100 may be turned off by releasing the switch trigger 446.

Please refer to FIG. 10. The blowing tube 45 is connected with a tail end of the air outlet tube 43, and an inner cavity of the blowing tube 45 forms an air outlet passage for air outlet. In this embodiment, the blowing tube 45 includes two parts, the two parts are assembled with each other along an axial direction. On one hand, the air outlet passage of the blowing tube 45 may be extended according to actual needs. On the other hand, it may be disassembled and stored after use, which is very convenient. Of course, in other embodiments, the blowing tube 45 may also be provided with only one part thereof, while eliminating the other part, which is not limited here.

Please refer to FIG. 17 through FIG. 20. This is a second embodiment of the axial flow blower 100 of the disclosure. In this embodiment, the axial flow blower 100 is a backpack blower, including an air passage 10', a motor 20', a fan blade 30' and a backpack battery pack 60.

In this embodiment, the air passage 10' includes a second air inlet tube 11', a duct 12', a bellow tube 14' and a blowing head assembly 13' which are arranged in sequence. Specifically, the duct 12' is connected with the second air inlet tube 11', and the motor 20' is installed in the duct 12'. The duct 12' is connected with the blowing head assembly 13' through the bellow tube 14'. The air passage 10' is movably connected with the backpack battery pack 60, and the motor 20' is electrically connected with the backpack battery pack 60.

In this embodiment, a relative movement between the second air inlet tube 11' and the backpack battery pack 60 is restricted. Therefore, in order to enable a blowing direction of the blowing head assembly 13' to be freely adjusted, a flexible bellow tube 14' is arranged between the blowing head assembly 13' and the duct 12' in this embodiment.

A sound insulation layer is arranged on an inner wall of the air passage 10'. It may be understood that the sound insulation layer can further reduce working noise of the backpack blower and improve a working environment of the operator. The sound insulation layer may be sound insulation cotton. The sound insulation layer includes a first sound insulation layer 111 arranged in the second air inlet tube 11', and a second sound insulation layer 141 arranged on an inner wall of the bellow tube 14'. The first sound insulation layer 111 is a conical structure, and an outer wall of the first sound insulation layer 111 is provided with a backing adhesive 112. The first sound insulation layer 111 is bonded and fixed to an inner wall of the second air inlet tube 11' through the backing adhesive 112.

The second sound insulation layer 141 is a tubular structure, and a protruding part in a bellow shape is arranged on an outer wall of the second sound insulation layer 141, and the protruding part is embedded in a trough of the inner wall of the bellow tube 14'.

A casing 40' is arranged outside the second air inlet tube 11' and the duct 12', a control module 50' is arranged inside the casing 40', a handle part 41' is arranged an outside the blowing head assembly 13', a switch assembly 42' is arranged on the handle part 41', and the switch assembly 42' and the motor 20' are electrically connected with the control module 50'.

Please refer to FIG. 21 through FIG. 28. This is a third embodiment of the axial flow blower 100 of the disclosure. In this embodiment, the axial flow blower 100 is a handheld blower. The handheld blower includes an air passage 10", a motor 20" and a fan blade 30", and the motor 20" and the fan blade 30" are coaxially arranged with the air passage 10". The fan blade 30" covers most area of the air passage 10", and a sufficient space is reserved between the motor 20" and an inner wall of the air passage 10" for the air flow to pass through. In order to prevent a turbulence at a rear end of the motor 20", a guiding cone may further be installed at the rear end of the motor 20".

The air passage 10" of the disclosure is a functional feature, which mainly refers to a semi-enclosed space of a certain length which is closed circumferentially and open at two ends. There is no special restriction on a specific structure of the air passage 10", for example, the air passage 10" may be in a tubular shape with one end being continuous, or it may also be formed by multiple tubular sections being spliced axially, or it may also be formed by more than two arc-shaped housings being spliced circumferentially.

In this disclosure, a power P of the motor 20" is greater than or equal to 1500 W, and a maximum rotating speed n is greater than or equal to 30000 RPM. The fan blade 30" is connected with a main shaft of the motor 20". A diameter d of the fan blade 30" is greater than or equal to 84 mm, and the fan blade 30" is made of a metal material with a density p less than or equal to 2.8 g/cm$^3$.

It may be understood that, in the disclosure, the diameter of the fan blade 30", the power of the motor 20", the maximum rotating speed of the motor 20" and other parameters are all greater than those of the traditional blower, and can generate greater blowing force to meet use requirements under complex working conditions.

It should be noted that, an improvement of power components in the disclosure is not only reflected in a change of parameters. In fact, simply changing the parameters of the power components without changing the conventional design will lead to a series of derivative problems. For example, simply increasing the above parameters will increase a load on the fan blades. Since the fan blades in the conventional art are generally made of plastic, a vibration of the fan blades will be aggravated, which will increase the noise and reduce a duration life of the fan blades. In order to overcome the above-mentioned problems, low-density metal material is adopted to manufacture the fan blade 30", which can effectively improve a stability of the fan blade 30", reduce the working noise, and increase the duration life of the fan blade 30". Therefore, the disclosure overcomes a prejudice of the conventional art and give a breakthrough improvement in a working performance of the blower.

Figure 25:
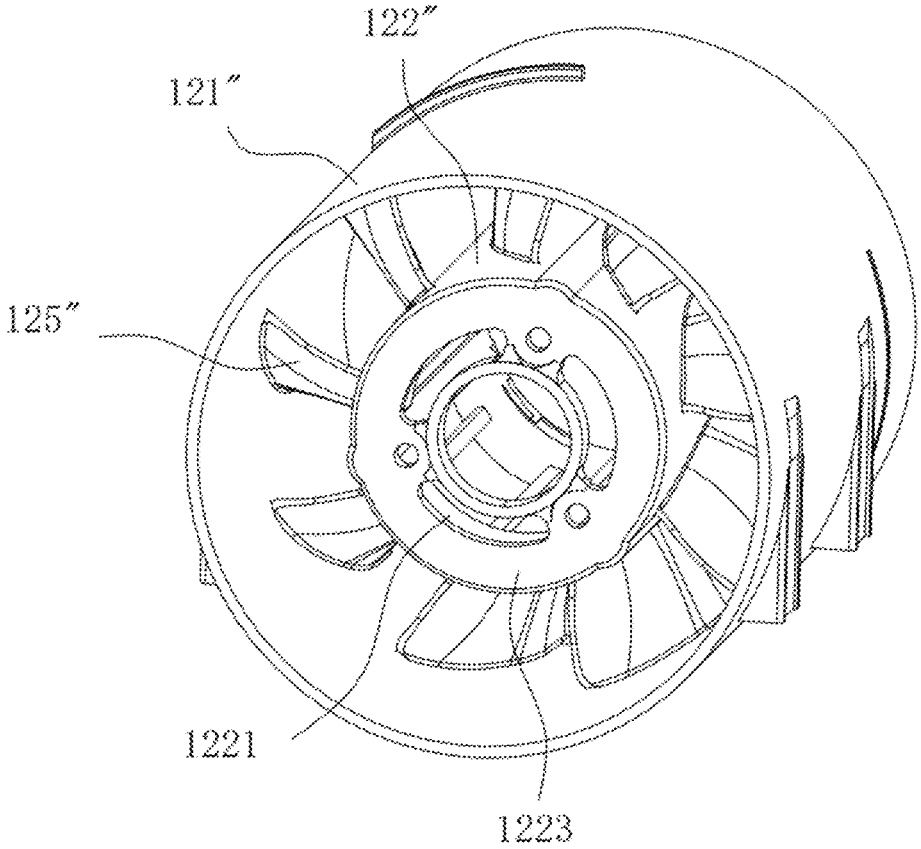
FIG. 25 is a perspective view of the duct in FIG. 24 according to at least one embodiment of the disclosure.
Figure 26:
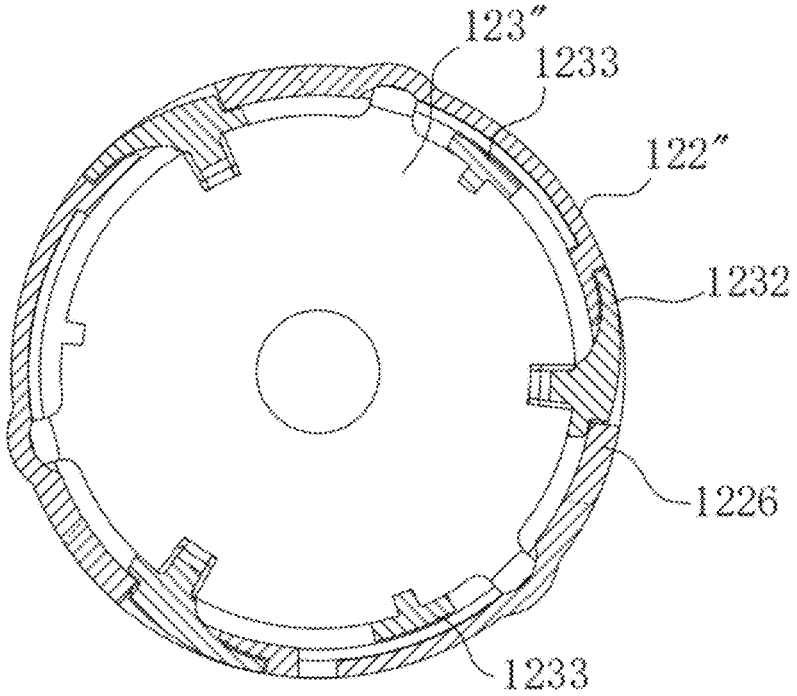
FIG. 26 is a cross-sectional view taken along line A-A of FIG. 23.
Figure 27:
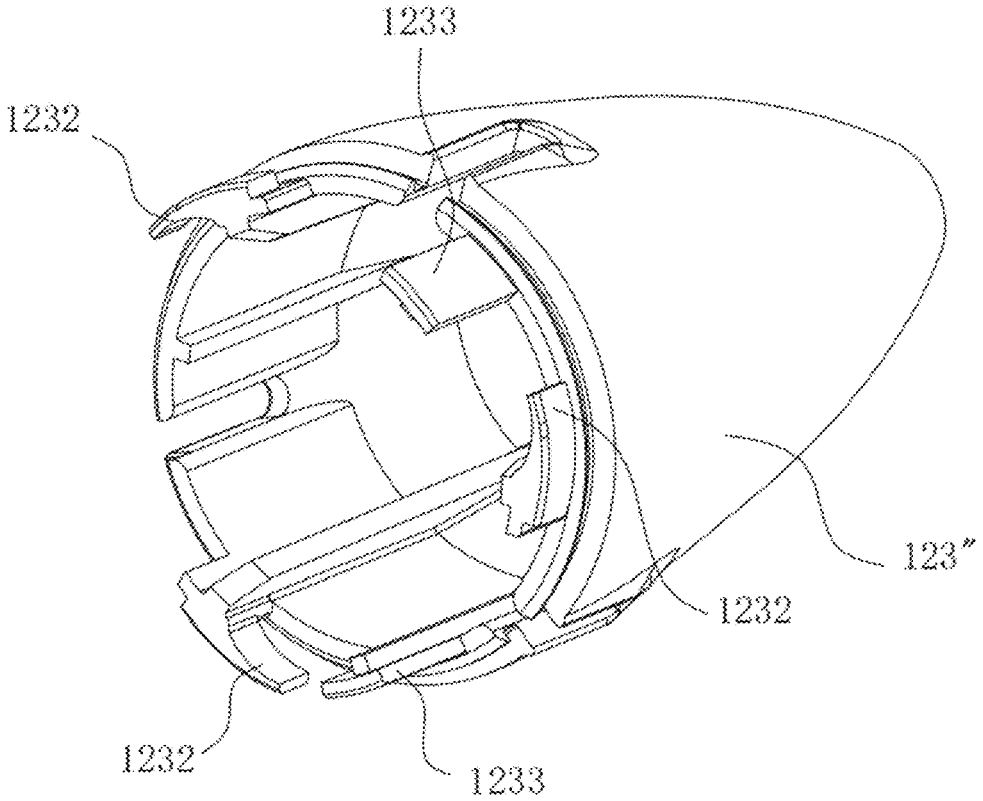
FIG. 27 is a perspective view of a guiding cone in FIG. 24 according to at least one embodiment of the disclosure.
Figure 28:
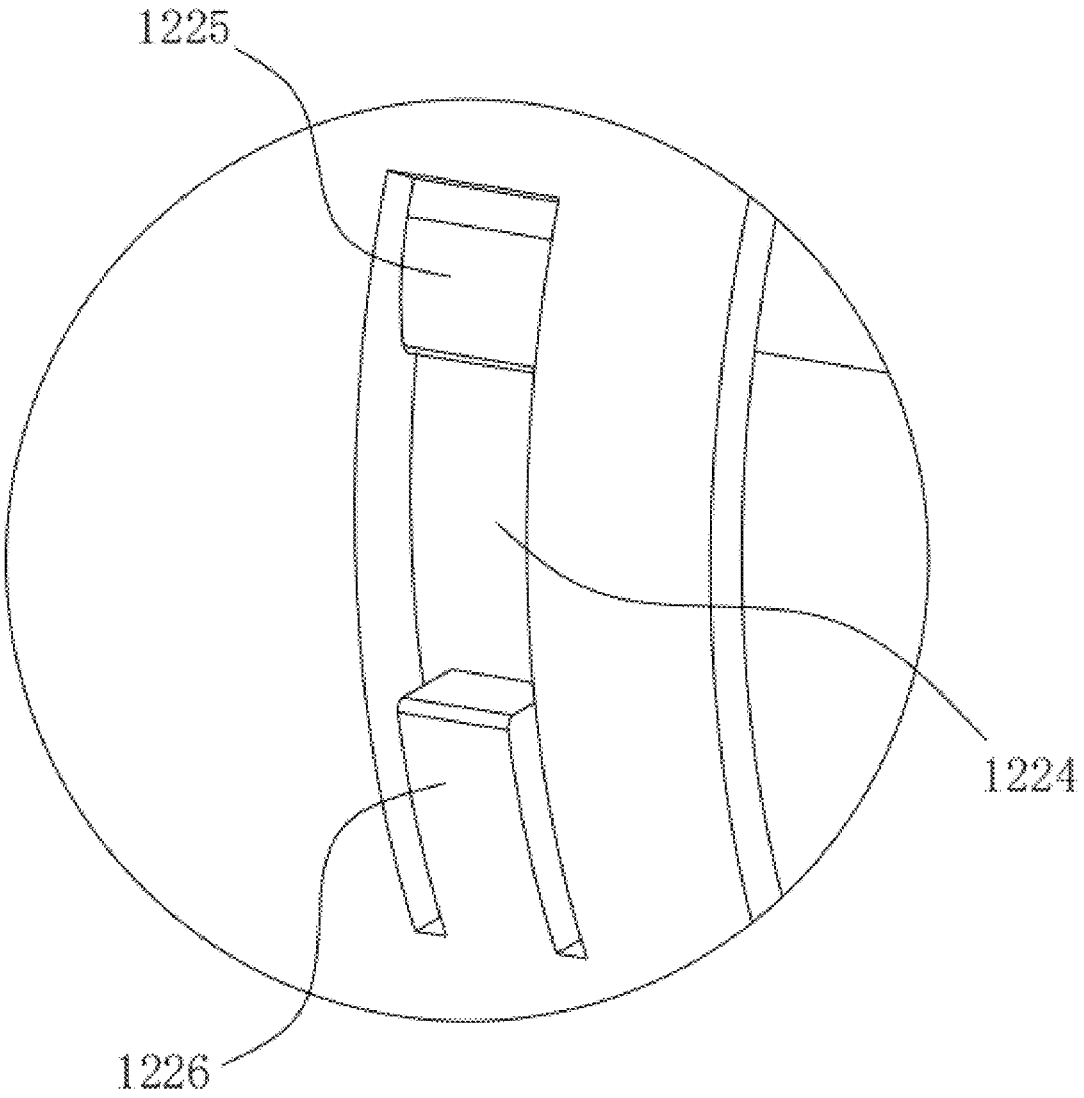
FIG. 28 is a partial enlarged view of an area I in FIG. 24.

Please refer to FIG. 25. The duct 12" includes an outer tube 121" and an inner tube 122". The inner tube 122" is located at a center of the outer tube 121" and is spaced apart from an inner wall of the outer tube 121", and the outer tube 121" and the inner tube 122" are connected through a spoke plate 125". The motor 20" is installed in the inner tube 122", and there is a plurality of the spoke plates 125". The plurality of spoke plates 125" is arranged along a circumferential direction of the inner tube 122" at intervals. A plate surface of the spoke plate 125" is tilted relative to an axis of the inner tube 122" so that the air flow can generate a circumferential deflection when passing through the spoke plate 125".

When the air flow passes through the spoke plate 125", it will inevitably be blocked and cut by the spoke plate 125". In this embodiment, the spoke plate 125" can guide the air flow so that the air flow flows downstream in a spiral shape after passing through the spoke plate 125". This can avoid the air flow interfering with each other after passing through the spoke plate 125" and generating turbulence, thereby improving a passability of the air flow and further reducing the noise in the air passage 10" at the same time.

Figure 23:
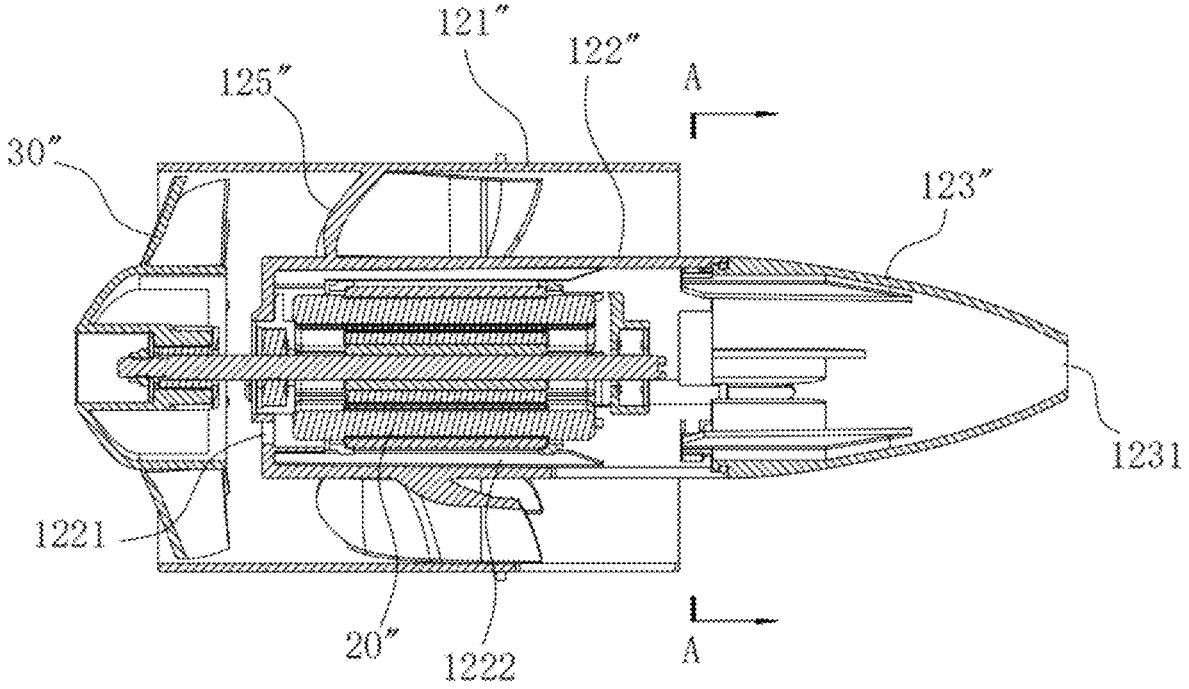
FIG. 23 is a cross-sectional view of a duct and accessories of the duct in FIG. 22 according to at least one embodiment of the disclosure.
Figure 24:
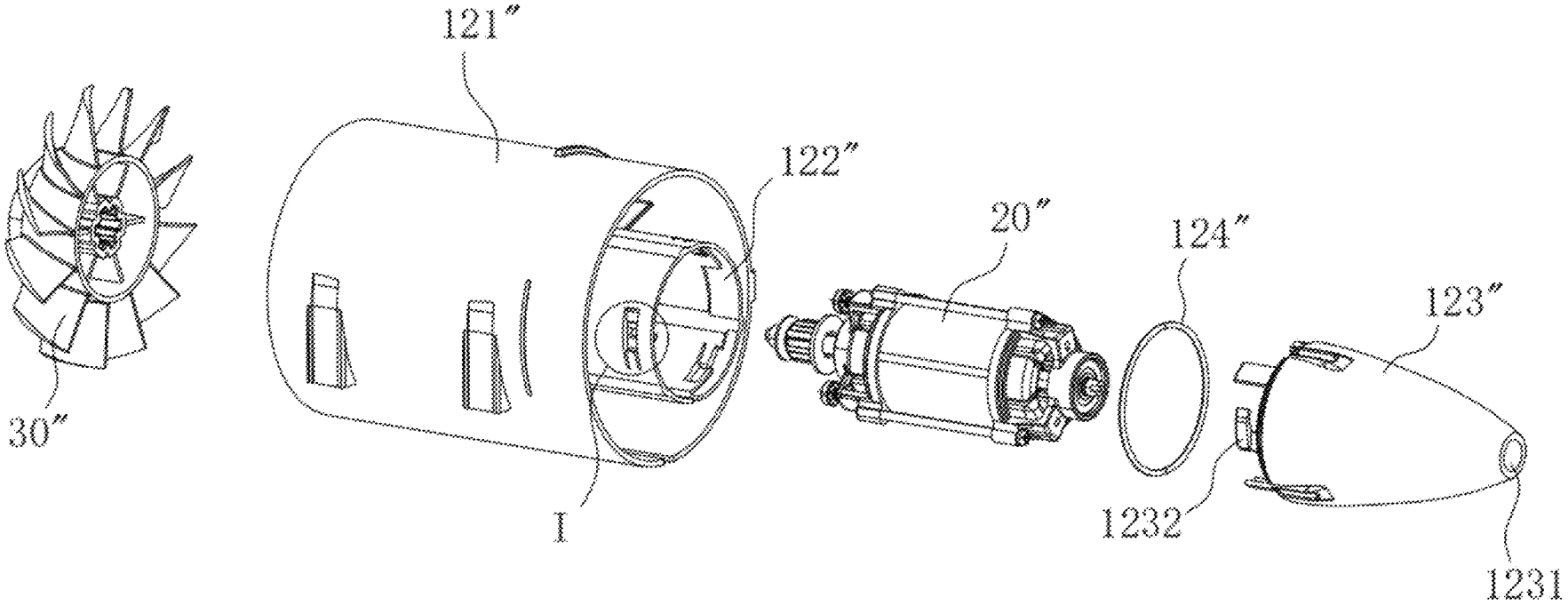
FIG. 24 is an exploded view of the duct and the accessories of the duct in FIG. 23 according to at least one embodiment of the disclosure.

Please refer to FIG. 23 and FIG. 25. An end plate 1223 is arranged at one end of the inner tube 122" close to the fan blade 30", and an air inlet hole 1221 is arranged on the end plate 1223. A guiding cone 123" is arranged at one end of the inner tube 122" away from the fan blade 30", and an air outlet hole 1231 is arranged at a tail part of the guiding cone 123". A heat dissipation passage 1222 communicating the air inlet hole 1221 with the air outlet hole 1231 is arranged between the motor 20" and the inner tube 122". In this embodiment, the air flow generated by the fan blades 30" can pass through the inner tube 122", and then exchange heat with the motor 20" in the inner tube 122", which takes away the heat generated by the motor 20", realizes an automatic cooling of the motor 20", and can effectively increase a duration life of the motor 20".

Please refer to FIG. 23 through FIG. 28. The guiding conc 123" is connected with the inner tube 122" in a detachable manner, and a quick connection mechanism is arranged between the guiding cone 123" and the inner tube 122". The quick connection mechanism includes an inserting block 1232 fixedly connected with the guiding cone 123". The inserting block 1232 is cantilevered along the circumferential direction of the guiding cone 123", and an inserting hole 1224 matched with the inserting block 1232 is arranged on a tube wall of the inner tube 122". A first end of the inserting hole 1224 is provided with a sinking groove 1225 formed on an outer wall of the inner tube 122", and a second end of the inserting hole 1224 is provided with a stop block 1226 cantilevered into the inserting hole 1224 along the circumferential direction of the inner tube 122". It may be understood that, the guiding cone 123" is detachably connected with the inner tube 122", which is convenient for installing and disassembling the motor 20". At the same time, this embodiment provides the quick connection mechanism between the guiding cone 123" and the inner tube 122", which can realize a rapid installation and removal of the guiding cone 123" and the inner tube 122".

During installation, external force is first used to enable the inserting block 1232 to shrink radially inward, then the inserting block 1232 is inserted into the inner tube 122", and then the guiding cone 123" is rotated. During this process, the stop block 1226 will produce an elastic deformation radially outward. When the guiding cone 123" rotates a certain angle, the inserting block 1232 is clamped in the sinking groove 1225 under an action of its own elastic force. At this time, the stop block 1226 is just offset from the inserting block 1232. The stop block 1226 is reset under the action of its own elastic force, and then abuts against an end part of the inserting block 1232 to prevent the guiding conc 123" from reversing.

In this embodiment, in order to facilitate an insertion of the guiding cone 123" into the inner tube 122", a positioning plate 1233 is further arranged on the guiding cone 123". When the guiding cone 123" and the inner tube 122" are assembled, the positioning plate 1233 fits against an inner wall of the inner tube 122". In order to further improve a stability between the guiding cone 123" and the inner tube 122", a rubber ring 124" may be arranged between the guiding cone 123" and the inner tube 122".

In this embodiment, the fan blade 30" is made of magnesium alloy or aluminum alloy. A density of magnesium alloy is generally about 1.8 g/cm$^3$, and a density of aluminum alloy is generally about 2.7 g/cm$^3$. The disclosure adopts the low-density metal alloy to manufacture the fan blade 30", which improves a structural strength of the fan blade 30", realizes a lightweight design of the fan blade 30", reduces energy loss, and improves working efficiency.

The disclosure preferably selects the following two groups of parameters. Through experimental measurements, it is found that under the following two groups of parameter conditions, the handheld blower can achieve a better energy conversion rate.

First, when the power P of the motor 20" is 1500 W, the diameter d of the fan blade 30" is 84 mm.

Second, when the power P of the motor 20" is 2000 W, the diameter d of the fan blade 30" is 96 mm.

Comparison data of the above two sets of parameters with other reference embodiments are as follows:

| Test state | Fan blade (mm) | Rotating speed (RPM) | Peak air speed (mph) | Air volume (cfm) | Blowing force (g) |
|---|---|---|---|---|---|
| 1500 W | 84 | 29950 | 174 | 590 | 2270 |
| | 89 | 29990 | 173 | 592 | 2250 |
| | 96 | 29960 | 169 | 580 | 2245 |
| | 98 | 29975 | 168 | 586 | 2216 |
| 2000 W | 84 | 29950 | 190 | 650 | 2735 |
| | 89 | 29990 | 186 | 636 | 2620 |
| | 96 | 29960 | 193 | 657 | 2795 |
| | 98 | 29975 | 189 | 644 | 2690 |

It may be seen from the above table that under the above two sets of optimal parameter conditions, the working efficiency of the handheld blower is significantly higher than that under other parameter conditions.

Figure 22:
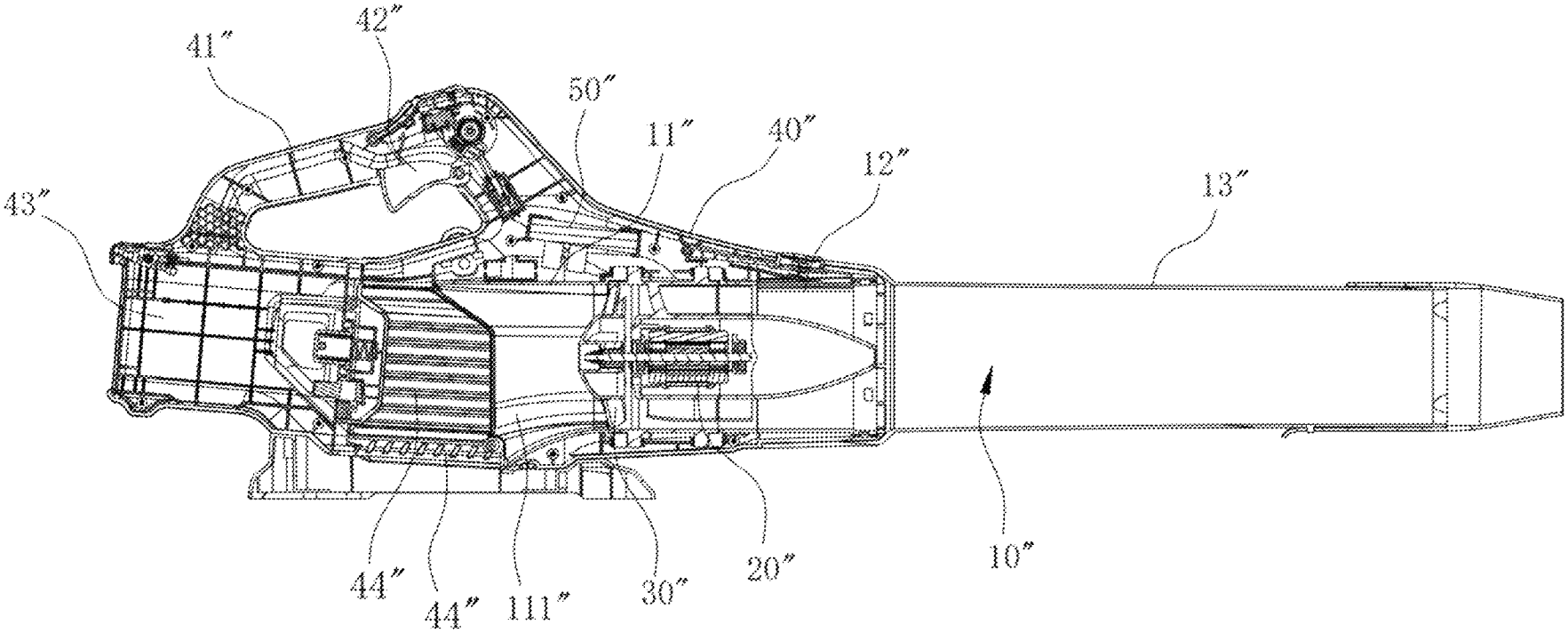
FIG. 22 is a cross-sectional view of the handheld blower in FIG. 21 according to at least one embodiment of the disclosure.

Please refer to FIG. 22. Further, the sound insulation layer is arranged on an inner wall of the air passage 10' to further reduce the working noise of the handheld blower and improve the working environment of the operator. In this embodiment, the sound insulation layer may be sound insulation cotton.

The air passage 10" includes the second air inlet tube 11", the duct 12", and the blowing head assembly 13" which are arranged in sequence. Specifically, the duct 12" is connected with the second air inlet tube 11", and the motor 20" is installed in the duct 12". The blowing head assembly 13" is connected with the duct 12". The sound insulation layer at least includes the first sound insulation layer 111" arranged on the inner wall of the second air inlet tube 11".

The air passage 10" is arranged as a multi-section structure, which helps to alleviate the vibration and noise. The motor 20" and the fan blade 30" are only arranged in the duct 12", so as to isolate the vibration generated by the motor 20" and the fan blade 30". For example, buffer washers may be arranged between the duct 12" and the second air inlet tube 11", and between the duct 12" and the blowing head assembly 13". It is understandable that a cantilevering distance of the blowing head assembly 13" is relatively long. The buffer washers provided between the duct 12" and the blowing head assembly 13" in the disclosure can suppress the vibration from being transmitted from the duct 12" to the blowing head assembly 13", thereby avoiding a resonance of the blowing head assembly 13". While reducing noise, the structural stability of the air passage 10" is improved at the same time, and the duration life of the handheld blower is further improved.

A casing 40" is arranged outside the second air inlet tube 11" and the duct 12". A handle part 41" is formed on the casing 40", a switch assembly 42" is arranged on the handle part 41", a control module 50" is arranged in the housing 40", and the switch assembly 42" and the motor 20" are electrically connected with the control module 50". A battery pack compartment 43" is further formed on the casing 40", a battery pack (not shown) is installed in the battery pack compartment 43", and the battery pack is electrically connected with the control module 50". The battery pack compartment 43" is located at a rear end of the second air inlet tube 11", and a fourth air inlet 44" is arranged on a side wall and a bottom wall of the casing 40" between the battery pack compartment 43" and the second air inlet tube 11". In order to further alleviate the noise and the vibration, a buffer pad may be arranged between the duct 12" and the casing 40".

In summary, the axial flow blower 100 of the disclosure sets the diameter of the fan blades 54 to be from 64 mm to 100 mm and the diameter of the motor 52 to be from 30 mm to 50 mm at the same time, so that the power of the axial flow blower 100 can be greater than or equal to 2000 W and the blowing force is greater than or equal to 2500 g, thereby achieving a high power and a high blowing force and improving the overall performance of the axial flow blower 100, which may fully compete with gasoline blowers and improve the market advantages.

In addition, the guiding cone 53 are configured to extend into the bent tube 41, and a distance between a tail end port of the guiding cone 53 and a central axis of the second air outlet of the bent tube 41 is greater than or equal to 75 mm, so that not only the blowing force loss can be reduced, but also the overall performance of the axial flow blower 100 can be improved.

The above embodiments are only used to illustrate the technical solution of the disclosure and are not intended to limit it. Although the disclosure has been described in detail with reference to the preferred embodiments, a person skilled in the art should understand that the technical solution of the disclosure may be modified or replaced by equivalents without departing the disclosure.

What is claimed is:

1. An axial flow blower, comprising:

a housing assembly;

an air inlet assembly, the air inlet assembly assembled with the housing assembly;

an air outlet assembly; and a motor duct assembly, the motor duct assembly connected between the air inlet assembly and the air outlet assembly, wherein, the motor duct assembly comprises a duct body, a motor fixed inside the duct body, a guiding cone mounted and matched with a first end of the duct body, a fan blade mounted and matched with a second end of the duct body, the fan blade is fixed on a motor shaft of the motor, and a diameter of the fan blade is from 64 mm to 100 mm, and a diameter of the motor is from 30 mm to 50 mm, so as to enable a power of the axial flow blower to be greater than or equal to 2000 W and a blowing force to be greater than or equal to 2500 g, wherein the fan blade is a metal fan blade, and a density of the metal fan blade is less than or equal to 6.8 g/cm$^3$, so as to enable a dynamic balance value of the fan blade to be from 2 mg to 20 mg.

2. The axial flow blower according to claim 1, wherein, a power P of the motor is greater than or equal to 1500 W, a maximum rotating speed n is greater than or equal to 30000 RPM, the diameter d of the fan blade is greater than or equal to 84 mm, and the fan blade is made of a metal material with a density p less than or equal to 2.8 g/cm$^3$.

3. The axial flow blower according to claim 2, wherein, the power P of the motor is 1500 W or 2000 W, when the power P of the motor is 1500 W, the diameter d of the fan blade is 84 mm, and when the power P of the motor is 2000 W, the diameter d of the fan blade is 96 mm.

4. The axial flow blower according to claim 1, wherein, the fan blade is accommodated in the duct body, and a gap is left between a tail end of the fan blade and an inner wall surface of the duct body in a radial direction of the fan blade.

5. The axial flow blower according to claim 4, wherein, the gap is less than or equal to 1.2 mm.

6. The axial flow blower according to claim 1, wherein, a second air inlet is arranged on a side of the duct body close to the fan blade, a first air outlet is arranged on a side of the guiding cone away from the fan blade, and the second air inlet is communicated with the first air outlet to form an air flow passage in the duct body.

7. The axial flow blower according to claim 6, wherein, the duct body is provided with an accommodating part to accommodate the motor, an accommodating cavity is formed in the accommodating part, the motor is accommodated in the accommodating cavity, the second air inlet is arranged on a side of the accommodating part close to the fan blade, and the air flow passage passes through the motor and the accommodating cavity from the second air inlet to reach the first air outlet.

8. An axial flow blower, comprising:

a housing assembly;

an air inlet assembly, the air inlet assembly assembled with the housing assembly;

an air outlet assembly; and a motor duct assembly, the motor duct assembly connected between the air inlet assembly and the air outlet assembly, wherein, the motor duct assembly comprises a duct body, a motor fixed inside the duct body, and a guiding cone mounted and matched with an end of the duct body, the air inlet assembly comprises a first air inlet and a first air inlet tube connected with the first air inlet, the first air inlet tube is connected with the duct body, the air outlet assembly comprises a bent tube, a bellow tube fixedly connected with the bent tube, and an air outlet tube fixedly connected with the bellow tube, the guiding cone extends into the bent tube, and a distance between a tail end port of the guiding cone and a central axis of a second air outlet of the bent tube is greater than or equal to 75 mm.

9. The axial flow blower according to claim 8, wherein, the distance between the tail end port of the guiding cone and the central axis of the second air outlet of the bent tube is greater than or equal to 80 mm.

10. The axial flow blower according to claim 8, wherein, the central axis of the second air outlet of the bent tube is a same axis as a central axis of the bellow tube, one end of a third air inlet of the bent tube extends into the duct body and is rotatably connected with the duct body, and a central axis of the third air inlet of the bent tube is a same axis as a central axis of the duct body.

11. The axial flow blower according to claim 10, wherein, a housing part is arranged at one end of the duct body close to the bent tube, an inner diameter of the housing part is greater than or equal to an outer diameter of the duct body to form a housing cavity in the housing part, and one end of the third air inlet of the bent tube is accommodated in the housing cavity.

12. The axial flow blower according to claim 11, wherein, a clamping groove is arranged at one end of the third air inlet of the bent tube, an engagement part is arranged on a side of the housing assembly close to the bent tube, the engagement part is accommodated in the clamping groove and capable of sliding along the clamping groove to snap connect the bent tube with the housing assembly and enable the bent tube to be capable of rotating relative to the housing assembly.

13. The axial flow blower according to claim 12, wherein, the housing part is accommodated in the housing assembly and is located on an inner side of the engagement part, and an angle at which the bent tube rotates relative to the housing assembly is greater than or equal to 90°.

14. The axial flow blower according to claim 8, further comprising a power supply assembly arranged in the housing assembly, wherein, the power supply assembly comprises a battery pack and a circuit board located below the battery pack, a first heat dissipation hole communicated with the first air inlet is opened on a side wall of the first air inlet tube, and the first heat dissipation hole is arranged corresponding to the circuit board to dissipate heat generated by the circuit board during operation through the first heat dissipation hole.

15. The axial flow blower according to claim 14, wherein, a second heat dissipation hole communicated with the first air inlet is further arranged on a top wall of the first air inlet tube, the housing assembly is provided with a battery pack cavity to accommodate the battery pack, a bottom of the battery pack cavity is communicated with the second heat dissipation hole, and a top of the battery pack cavity is provided with a third heat dissipation hole communicated with an outside.

16. The axial flow blower according to claim 15, wherein, the housing assembly further comprises a fan arranged close to the third heat dissipation hole, after the fan is started, and the fan is configured to drive air flow entering the first air inlet tube from the first air inlet to enter the battery pack cavity through the second heat dissipation hole, and then drive the air flow to flow out from the third heat dissipation hole to take away heat in the battery pack cavity.

17. The axial flow blower according to claim 8, wherein, a noise reduction sponge is arranged on an inner side wall of the first air inlet tube to reduce noise during air inlet, another noise reduction sponge is further arranged on an inner side wall of the bellow tube to reduce noise during air outlet, and a thickness of each of the noise reduction sponges is greater than or equal to 4 mm.

18. The axial flow blower according to claim 8, wherein, the air inlet assembly comprises a window and a second air inlet tube connected with the window, the second air inlet tube is connected with the duct body, an air inlet is opened on the window, and when a power of the axial flow blower is greater than 2000 W, an air inlet area of the window is greater than or equal to 11000 cubic millimeters.

19. The axial flow blower according to claim 8, wherein, the axial flow blower is a backpack blower or a handheld blower.

* * * * *